US012044251B2

(12) United States Patent
Enosawa et al.

(10) Patent No.: US 12,044,251 B2
(45) Date of Patent: Jul. 23, 2024

(54) VACUUM PUMP

(71) Applicant: Edwards Japan Limited, Chiba (JP)

(72) Inventors: Hideki Enosawa, Chiba (JP); Manabu Nonaka, Chiba (JP); Yasushi Maejima, Chiba (JP); Tsutomu Takaada, Chiba (JP)

(73) Assignee: Edwards Japan Limited, Chiba (JP)

( * ) Notice: Subject to any disclaimer, the term of this patent is extended or adjusted under 35 U.S.C. 154(b) by 249 days.

(21) Appl. No.: 17/436,426

(22) PCT Filed: Mar. 9, 2020

(86) PCT No.: PCT/JP2020/009951
§ 371 (c)(1),
(2) Date: Sep. 3, 2021

(87) PCT Pub. No.: WO2020/184503
PCT Pub. Date: Sep. 17, 2020

(65) Prior Publication Data

US 2022/0163053 A1 May 26, 2022

(30) Foreign Application Priority Data

Mar. 13, 2019 (JP) ..... 2019-045825

(51) Int. Cl.
*F04D 29/66* (2006.01)
*F04D 19/04* (2006.01)
(Continued)

(52) U.S. Cl.
CPC ..... *F04D 29/666* (2013.01); *F04D 19/042* (2013.01); *F04D 29/388* (2013.01); *F04D 29/644* (2013.01); *F04D 29/662* (2013.01)

(58) Field of Classification Search
CPC ..... F04D 19/04; F04D 19/042; F04D 29/662
See application file for complete search history.

(56) References Cited

U.S. PATENT DOCUMENTS

2005/0025640 A1 2/2005 Sekiguchi et al.
2009/0246038 A1* 10/2009 Kawasaki ..... F04D 17/168 417/203
(Continued)

FOREIGN PATENT DOCUMENTS

CN 109690024 A * 4/2019 ..... F01D 25/285
EP 3139044 A1 * 3/2017 ..... F04D 17/168
(Continued)

OTHER PUBLICATIONS

European Communication dated May 15, 2023 for corresponding European application Serial No. 20769660.0, 8 pages.
(Continued)

*Primary Examiner* — J. Todd Newton
*Assistant Examiner* — Jackson N Gillenwaters
(74) *Attorney, Agent, or Firm* — Theodore M. Magee; Westman, Champlin & Koehler, P.A.

(57) ABSTRACT

A vacuum pump includes: a particle transferring portion that functions as a means for transferring a particle in an exhaust direction of the gas particle by increasing or reducing a height of an upstream end of at least a part of rotor blades among a plurality of rotor blades that constitute an uppermost exhaust stage to realize a stepped structure in which heights of the upstream ends differ as the uppermost exhaust stage as a whole, and in a rotating body constituted by the plurality of rotor blades, the particle transferring portion, and a cylindrical portion that supports the plurality of rotor blades, an imbalance created with respect to the rotating body as a whole by a presence of a rotor blade of which a height of the upstream end has become higher than other rotor blades due to the stepped structure has been corrected.

18 Claims, 22 Drawing Sheets

(51) Int. Cl.
*F04D 29/38* (2006.01)
*F04D 29/64* (2006.01)

(56) References Cited

U.S. PATENT DOCUMENTS

| | | | | |
|---|---|---|---|---|
| 2013/0164124 | A1* | 6/2013 | Ohtachi | F04D 1/00 415/183 |
| 2015/0063993 | A1* | 3/2015 | Tsutsui | F04D 19/042 415/200 |
| 2019/0055949 | A1* | 2/2019 | Watanabe | F04D 19/042 |

FOREIGN PATENT DOCUMENTS

| | | | | |
|---|---|---|---|---|
| EP | 3139044 | A1 | 3/2017 | |
| JP | 662168237 | | 10/1987 | |
| JP | 2003065281 | A * | 3/2003 | F04D 19/042 |
| JP | 2011144713 | A | 7/2011 | |
| WO | 2018173341 | A1 | 9/2018 | |
| WO | 2018174013 | A1 | 9/2018 | |

OTHER PUBLICATIONS

PCT International Search Report dated Jun. 9, 2020 for corresponding PCT application Serial No. PCT/JP2020/009951, 2 pages.
PCT International Written Opinion dated Jun. 9, 2020 for corresponding PCT application Serial No. PCT/JP2020/009951, 3 pages.

* cited by examiner $Pi2 < Pi3$

Pi4 < Pi5

Pi6 < Pi7

VACUUM PUMP

CROSS-REFERENCE OF RELATED APPLICATION

This application is a Section 371 National Stage Application of International Application No. PCT/JP2020/009951, filed Mar. 9, 2020, which is incorporated by reference in its entirety and published as WO 2020/184503A1 on Sep. 17, 2020 and which claims priority of Japanese Application No. 2019-045825, filed Mar. 13, 2019.

BACKGROUND

The present invention relates to a vacuum pump to be used as a gas exhaust means of a process chamber in a semiconductor manufacturing apparatus, a flat panel display manufacturing apparatus, and a solar panel manufacturing apparatus and other vacuum chambers and, in particular, to a vacuum pump that prevents a backflow of a particle from the vacuum pump to a vacuum chamber side while securing a balance of a rotating body as a whole including a plurality of rotor blades and a particle transferring portion.

Vacuum pumps such as a turbo-molecular pump and a thread groove pump are being widely used to exhaust gas in a vacuum chamber that requires a high vacuum. FIG. 22 is a schematic view of an exhaust system that adopts a conventional vacuum pump as a gas exhaust means of a vacuum chamber.

A conventional vacuum pump Z that constitutes the exhaust system shown in FIG. 22 has a plurality of exhaust stages PT that exhaust a gas particle between an inlet port 2 and an outlet port 3.

Each exhaust stage PT in the conventional vacuum pump Z is structured such that, for each exhaust stage PT, a gas particle is exhausted by pluralities of rotor blades 7 and stator blades 8 that are radially arranged at prescribed intervals.

In the exhaust structure of a gas particle described above, the rotor blade 7 is integrally formed on an outer circumferential surface of a rotor 6 being rotatably supported by a bearing means such as a magnetic bearing, and the rotor blade 7 rotates at high speed together with the rotor 6. On the other hand, the stator blade 8 is fixed to an inner surface of a housing case 1.

In the exhaust system shown in FIG. 22, a chemical process such as CVD is performed inside a vacuum chamber CH, and it is assumed that a particulate process by-product that is secondarily produced by the chemical process floats and disperses inside the vacuum chamber CH and falls toward the inlet port 2 of the vacuum pump Z due to its own weight and a transfer effect created by a gas particle. It is also assumed that deposited material that is adhered to and deposited on an inner wall surface of the vacuum chamber CH and deposited material that is adhered to and deposited on a pressure control valve BL exfoliate due to vibration or the like and also fall toward the inlet port 2 of the vacuum pump Z due to their own weight.

In addition, a particle having arrived at the inlet port 2 due to falling as described above further falls from the inlet port 2 and enters an uppermost exhaust stage PT (PT1). When an incident particle Pa collides with the rotor blade 7 of the uppermost exhaust stage PT (PT1) rotating at high speed, the colliding particle is repelled by a collision with a blade edge portion that is positioned on a side of an upper end surface of the rotor blade 7 and rebounds and flows backward in a direction of the inlet port 2, thereby creating a risk that an inside of the vacuum chamber CH may become contaminated by such a particle of a backflow.

WO 2018/174013 discloses a means (hereinafter, referred to as a "particle backflow preventing means") for preventing the backflow of a particle described above. Specifically, a vacuum pump according to WO 2018/174013 has a plurality of exhaust stages that exhaust a gas particle between an inlet port and an outlet port and is provided with, in an uppermost exhaust stage PT (PT1) among the plurality of exhaust stages, a particle transferring portion (referred to as a particle transferring means in WO 2018/174013) as the particle backflow preventing means.

The particle transferring portion enables a particle to be transferred in an exhaust direction of a gas particle by increasing or reducing a height of an upstream end of at least a part of rotor blades among a plurality of rotor blades that constitute the uppermost exhaust stage PT (PT1) to realize a stepped structure in which heights of upstream ends differ as the uppermost exhaust stage PT (PT1) as a whole.

However, with a particle backflow preventing means such as that according to WO 2018/174013 described above, there is a problem in that a presence of a rotor blade of which a height of an upstream end has become higher than other rotor blades due to the stepped structure disrupts a balance of a rotating body (a component constituted by a plurality of rotor blades, a particle transferring portion, and a cylindrical portion that supports the plurality of rotor blades) as a whole and disrupts operation of the vacuum pump such as causing vibration or the like to occur during an operation of the vacuum pump.

The discussion above is merely provided for general background information and is not intended to be used as an aid in determining the scope of the claimed subject matter. The claimed subject matter is not limited to implementations that solve any or all disadvantages noted in the background.

SUMMARY

The present invention has been made in order to solve the problem described above and an object thereof is to provide a vacuum pump suitable for preventing a backflow of a particle from the vacuum pump to a vacuum chamber side while securing a balance of a rotating body as a whole including a plurality of rotor blades and a particle transferring portion.

In order to achieve the object described above, the present invention is a vacuum pump including: a plurality of exhaust stages that exhaust a gas particle between an inlet port and an outlet port; and a particle transferring portion that transfers a particle in an exhaust direction of the gas particle by increasing or reducing a height of an upstream end of at least a part of rotor blades among a plurality of rotor blades that constitute an uppermost exhaust stage PT (PT1) among the plurality of exhaust stages to realize a stepped structure in which heights of the upstream ends differ as the uppermost exhaust stage PT (PT1) as a whole, wherein in a rotating body constituted by the plurality of rotor blades, the particle transferring portion, and a cylindrical portion that supports the plurality of rotor blades, an imbalance created with respect to the rotating body as a whole by a presence of a rotor blade of which a height of the upstream end has become higher than other rotor blades due to the stepped structure has been corrected.

In the present invention, the imbalance may be corrected by removing a part of the rotor blade of which the height of the upstream end has been made higher than the other rotor blades due to the stepped structure or removing a part of a rotor blade in proximity of the rotor blade.

In the present invention, the imbalance may be corrected by removing, among an entire blade surface of the rotor blade of which the height of the upstream end has been made higher than the other rotor blades due to the stepped structure or among an entire blade surface of a rotor blade in proximity of the rotor blade, a predetermined amount of a rear surface side in a direction of rotation that contributes less to exhaust of the gas particle.

In the present invention, the imbalance may be corrected by removing a predetermined amount of a downstream end edge of the rotor blade of which the height of the upstream end has been made higher than the other rotor blades due to the stepped structure or removing a predetermined amount of a downstream end edge of a rotor blade in proximity of the rotor blade.

In the present invention, the imbalance may be corrected by forming a hole in the rotor blade of which the height of the upstream end has been made higher than the other rotor blades due to the stepped structure or forming a hole in a rotor blade in proximity of the rotor blade.

In the present invention, the imbalance may be corrected by forming a groove in the rotor blade of which the height of the upstream end has been made higher than the other rotor blades due to the stepped structure or forming a groove in a rotor blade in proximity of the rotor blade.

In the present invention, the imbalance may be corrected by setting a length in a radial direction of the rotor blade of which the height of the upstream end has been made higher than the other rotor blades due to the stepped structure or setting a length in a radial direction of a rotor blade in proximity of the rotor blade to be shorter than a length in the radial direction of the other rotor blades.

In the present invention, the imbalance may be corrected by removing a predetermined amount of an upstream end of a rotor blade in proximity of the rotor blade of which the height of the upstream end has been made higher than the other rotor blades due to the stepped structure.

In the present invention, the imbalance may be corrected by adding a mass to a rotor blade positioned on an opposite side with respect to a center of rotation of the rotor blade of which the height of the upstream end has been made higher than the other rotor blades due to the stepped structure or with respect to a center of rotation of a rotor blade in proximity of the rotor blade.

In the present invention, the imbalance may be corrected by elongating a downstream end edge of a rotor blade positioned on an opposite side with respect to a center of rotation of the rotor blade of which the height of the upstream end has been made higher than the other rotor blades due to the stepped structure or with respect to a center of rotation of a rotor blade in proximity of the rotor blade as compared to the other rotor blades.

In the present invention, the imbalance may be corrected by setting a length in a radial direction of a rotor blade positioned on an opposite side with respect to a center of rotation of the rotor blade of which the height of the upstream end has been made higher than the other rotor blades due to the stepped structure or setting a length in a radial direction of a rotor blade in proximity of the rotor blade to be longer than a length in the radial direction of the other rotor blades.

In the present invention, the imbalance may be corrected by increasing a thickness of a rotor blade positioned on an opposite side with respect to a center of rotation of the rotor blade of which the height of the upstream end has been made higher than the other rotor blades due to the stepped structure or increasing a thickness of a rotor blade in proximity of the rotor blade as compared to the other rotor blades.

In the present invention, the imbalance may be corrected by setting an arrangement interval, as viewed from a center of rotation of the rotating body, of at least two or more rotor blades positioned on a same side as the rotor blade of which the height of the upstream end has been made higher than the other rotor blades due to the stepped structure to be wider than an arrangement interval of the other rotor blades.

In the present invention, the imbalance may be corrected by setting an arrangement interval, as viewed from a center of rotation of the rotating body, of at least two or more rotor blades positioned on an opposite side to the rotor blade of which the height of the upstream end has been made higher than the other rotor blades due to the stepped structure to be narrower than an arrangement interval of the other rotor blades.

In the present invention, the imbalance may be corrected in an exhaust stage other than the uppermost exhaust stage PT (PT1).

In the present invention, the imbalance may be corrected by adding a depressed portion or a protruding portion to an outer circumferential surface of the cylindrical portion.

In the present invention, the imbalance may be corrected by shaving a part of a washer that is used to fasten the rotating body and a rotating shaft of the rotating body to each other.

In addition, the present invention is a rotating body of a vacuum pump including a plurality of exhaust stages that exhaust a gas particle between an inlet port and an outlet port and a particle transferring portion that transfers a particle in an exhaust direction of the gas particle by increasing or reducing a height of an upstream end of at least a part of rotor blades among a plurality of rotor blades that constitute an uppermost exhaust stage PT (PT1) among the plurality of exhaust stages to realize a stepped structure in which heights of the upstream ends differ as the uppermost exhaust stage PT (PT1) as a whole, wherein in the rotating body constituted by the plurality of rotor blades, the particle transferring portion, and a cylindrical portion that supports the plurality of rotor blades, an imbalance created with respect to the rotating body as a whole by a presence of a rotor blade of which a height of the upstream end has become higher than other rotor blades due to the stepped structure has been corrected.

Furthermore, the present invention is a vacuum pump including: a plurality of exhaust stages that exhaust a gas particle between an inlet port and an outlet port; and a particle transferring portion that transfers a particle in an exhaust direction of the gas particle, wherein in a rotating body constituted by the plurality of rotor blades, the particle transferring portion, and a cylindrical portion that supports the plurality of exhaust stages, an imbalance created with respect to the rotating body as a whole by installing the particle transferring portion has been corrected.

In the present invention, since a particle fallen from a vacuum chamber toward an inlet port of a vacuum pump is transferred in an exhaust direction of a gas particle by a particle transferring portion with a stepped structure and an imbalance created with respect to a rotating body as a whole by a presence of a rotor blade of which a height of an upstream end has become higher than other rotor blades due to the stepped structure or an imbalance created with respect to the rotating body as a whole by installing the particle transferring portion has been corrected, a vacuum pump suitable for preventing a backflow of a particle from the vacuum pump to a vacuum chamber side while securing a balance of the rotating body as a whole can be provided.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

FIGS. 21A and 21B are explanatory views of a seventh imbalance correcting structure, in which FIG. 21A is a sectional view of a rotating body provided with a washer and FIG. 21B is a plan view of the washer.

DETAILED DESCRIPTION

Hereinafter, a best mode for carrying out the present invention will be described in detail with reference to the accompanying drawings.

In the present embodiment, while a so-called composite blade vacuum pump provided with a turbo-molecular pump portion made up of a plurality of exhaust stages and a thread groove exhaust means will be described as an example of a vacuum pump, the present embodiment may be applied to a vacuum pump including only a turbo-molecular pump portion.

Figure 1:
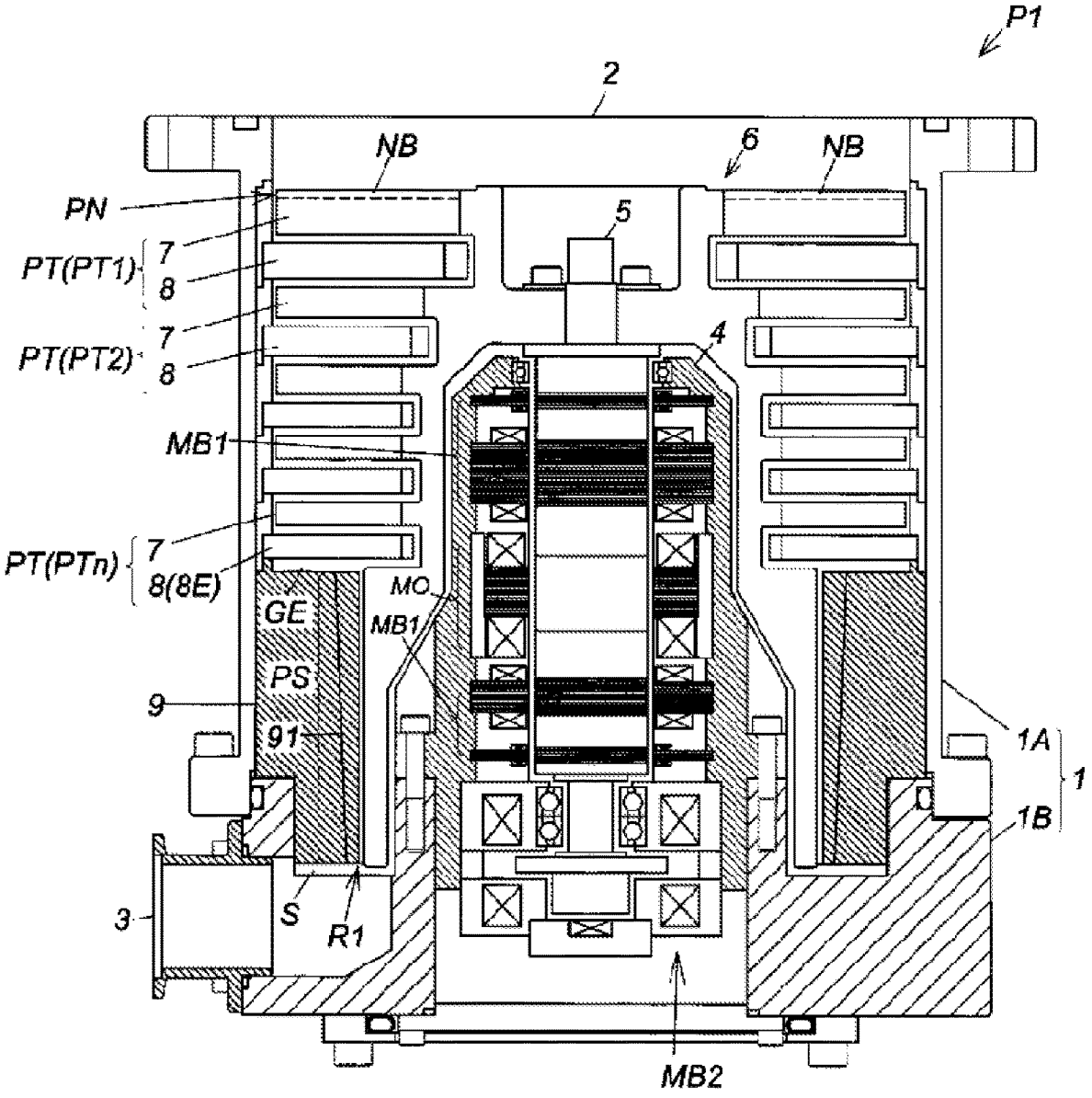
FIG. 1 is a sectional view of a vacuum pump to which the present invention is applied.

FIG. 1 is a sectional view of a vacuum pump to which the present invention is applied.

Referring to FIG. 1, a vacuum pump P1 illustrated therein is provided with a housing case 1 having a cylindrical cross section, a cylindrical portion 6 (a rotor) arranged inside the housing case 1, a supporting means that rotatably supports the cylindrical portion 6, and a driving means that rotates and drives the cylindrical portion 6.

The housing case 1 has a bottomed cylindrical shape in which a tubular pump case 1A and a bottomed tubular pump base 1B are integrally coupled to each other by fastening bolts in a tube axial direction thereof, an upper end portion side of the pump case 1A is opened as an inlet port 2 for sucking gas, and a lower end portion side surface of the pump base 1B is provided with an outlet port 3 for exhausting gas to outside of the housing case 1.

The inlet port 2 is connected via a pressure control valve BL (refer to FIG. 22) to a vacuum chamber CH (refer to FIG. 22) that becomes a high vacuum such as a process chamber of a semiconductor manufacturing apparatus or the like. The outlet port 3 is communicated with and connected to an auxiliary pump (not illustrated).

A cylindrical stator column 4 incorporating various electrical components is provided in a central portion inside the pump case 1A. While the stator column 4 is erected on the pump base 1B by forming the stator column 4 as a separate part from the pump base 1B and fixing the stator column 4 to an inner bottom of the pump base 1B by screws in the vacuum pump P1 shown in FIG. 1, as another embodiment, the stator column 4 may be integrally erected on the inner bottom of the pump base 1B.

The cylindrical portion 6 described earlier is provided on an outer side of the stator column 4. The cylindrical portion 6 has a cylindrical shape which is enclosed in the pump case 1A and the pump base 1B and which encloses an outer circumference of the stator column 4.

A rotating shaft 5 (a rotor shaft) is provided inside the stator column 4. The rotating shaft 5 is arranged so that an upper end portion thereof faces a direction of the inlet port 2 and a lower end portion thereof faces a direction of the pump base 1B. In addition, the rotating shaft 5 is rotatably supported by a magnetic bearing (specifically, two sets of a known radial magnetic bearing MB1 and one set of a known axial magnetic bearing MB2). Furthermore, a drive motor MO is provided inside the stator column 4 and the rotating shaft 5 is rotated and driven around an axial center thereof by the drive motor MO.

The upper end portion of the rotating shaft 5 protrudes upward from a cylinder upper end surface of the stator column 4, and an upper end side of the cylindrical portion 6 is integrally fixed by a fastening means such as bolts to the protruding upper end portion of the rotating shaft 5. Therefore, the cylindrical portion 6 is rotatably supported by the magnetic bearing (the radial magnetic bearings MB1 and the axial magnetic bearing MB2) via the rotating shaft 5, and when the drive motor MO is started in this supported state, the cylindrical portion 6 can integrally rotate with the rotating shaft 5 around a rotation axis thereof. In other words, in the vacuum pump P1 shown in FIG. 1, the rotating shaft 5 and the magnetic bearing function as a supporting means that rotatably supports the cylindrical portion 6 and the drive motor MO functions as a driving means that rotates and drives the cylindrical portion 6.

In addition, the vacuum pump P1 shown in FIG. 1 has a plurality of exhaust stages PT that exhaust a gas particle between the inlet port 2 and the outlet port 3.

In addition, in the vacuum pump P1 shown in FIG. 1, a thread groove pump stage PS is provided between a downstream portion of the plurality of exhaust stages PT or, more specifically, between a lowermost exhaust stage PT (PTn) among the plurality of exhaust stages PT and the outlet port 3.

The uppermost exhaust stage PT (PT1) among the plurality of exhaust stages PT is further provided with a particle transferring portion PN that transfers a particle in an exhaust direction of a gas particle.

Details of Exhaust Stage

In the vacuum pump P1 shown in FIG. 1, an upstream side of an approximate center of the cylindrical portion 6 functions as the plurality of exhaust stages PT. Hereinafter, the plurality of exhaust stages PT will be described in detail.

A plurality of rotor blades 7 that integrally rotate with the cylindrical portion 6 are provided on an outer circumferential surface of the cylindrical portion 6 on an upstream side of the approximate center of the cylindrical portion 6 and, for each of the exhaust stages PT (PT1, PT2, . . . PTn), the rotor blades 7 are radially arranged at predetermined intervals around a rotation center axis of the cylindrical portion 6 (specifically, an axial center of the rotating shaft 5) or an axial center of the housing case 1 (hereinafter, referred to as a "vacuum pump axial center").

On the other hand, a plurality of stator blades 8 are provided on an inner circumferential surface of the pump case 1A and, in a similar manner to the rotor blades 7, the stator blades 8 are also radially arranged at predetermined intervals around the vacuum pump axial center for each of the exhaust stages PT (PT1, PT2, . . . PTn).

In other words, each of the exhaust stages PT (PT1, PT2, . . . PTn) in the vacuum pump P1 shown in FIG. 1 has a gas exhaust structure which is provided with the pluralities of rotor blades 7 and stator blades 8 that are radially arranged at prescribed intervals and which exhausts a gas particle using the rotor blades 7 and stator blades 8 for each of the exhaust stages PT (PT1, PT2, . . . PTn).

Every rotor blade 7 is a blade-shaped cut product integrally formed by cutting with an outer diameter machined portion of the cylindrical portion 6 and is inclined at an optimal angle for exhausting a gas particle. Every stator blade 8 is also inclined at an optimal angle for exhausting a gas particle.

Explanation of Exhaust Operation by Plurality of Exhaust Stages

In the plurality of exhaust stages PT made up of the components described above, in the uppermost exhaust stage PT (PT1), due to start-up of the drive motor MO, the plurality of rotor blades 7 integrally rotate at high speed with the rotating shaft 5 and the cylindrical portion 6 and, using an inclined surface facing forward in a direction of rotation of the rotor blades 7 and facing downward (a direction from the inlet port 2 toward the outlet port 3, hereinafter referred to as downward), and impart a downward and tangential momentum to a gas particle incident from the inlet port 2. The gas particle having the downward momentum is sent to a next exhaust stage PT (PT2) by a downward inclined surface in an opposite direction in the direction of rotation to the rotor blades 7 which are provided on the stator blades 8. In the next exhaust stage PT (PT2) and subsequent exhaust stages PT, in a similar manner to the uppermost exhaust stage PT (PT1), the rotor blades 7 rotate and, due to imparting of a momentum to a gas particle by the rotor blades 7 and a sending operation of the gas particle by the stator blades 8 as described above, a gas particle near the inlet port 2 is exhausted so as to sequentially move toward downstream of the cylindrical portion 6.

Detail of Thread Groove Pump Stage

In the vacuum pump P1 shown in FIG. 1, a downstream side of the approximate center of the cylindrical portion 6 is configured to function as the thread groove pump stage PS. Hereinafter, the thread groove pump stage PS will be described in detail.

The thread groove pump stage PS has a thread groove exhaust portion stator 9 as a means for forming a thread groove exhaust flow path R on an outer circumferential side of the cylindrical portion 6 (specifically, an outer circumferential side of a portion of the cylindrical portion 6 that is on a downstream side of the approximate center of the cylindrical portion 6), and the thread groove exhaust portion stator 9 is mounted to an inner circumferential side of the housing case 1 as a fixed member.

The thread groove exhaust portion stator 9 is a cylindrical fixed member which is arranged so that an inner circumferential surface thereof opposites an outer circumferential surface of the cylindrical portion 6 and is arranged so as to enclose the portion of the cylindrical portion 6 that is on a downstream side of the approximate center of the cylindrical portion 6.

In addition, the portion of the cylindrical portion 6 that is on a downstream side of the approximate center of the cylindrical portion 6 is a portion which rotates as a rotating member of the thread groove exhaust portion PS and which is inserted into and housed inside the thread groove exhaust portion stator 9 via a predetermined gap.

A thread groove 91 of which a depth varies in a tapered cone shape with a diameter that decreases downward is formed in an inner circumferential portion of the thread groove exhaust portion stator 9. The thread groove 91 is engraved in a spiral shape from an upper end toward a lower end of the thread groove exhaust portion stator 9.

Due to the thread groove exhaust portion stator 9 provided with the thread groove 91 described above, the thread groove exhaust flow path R for exhausting gas is formed on an outer circumferential side of the cylindrical portion 6. Alternatively, although not illustrated, a configuration may be adopted in which the thread groove exhaust flow path R described above is provided by forming the thread groove 91 described earlier on the outer circumferential surface of the cylindrical portion 6.

In the thread groove exhaust portion PS, since gas is transferring while being compressed by a drag effect created by the thread groove 91 and the outer circumferential surface of the cylindrical portion 6, the depth of the thread groove 91 is set so as to be deepest on an upstream inlet side of the thread groove exhaust flow path R (a flow path opening end near the inlet port 2) and shallowest on a downstream outlet side of the thread groove exhaust flow path R (a flow path opening end near the outlet port 3).

The inlet (an upstream opening end) of the thread groove exhaust flow path R opens toward a gap (hereinafter, referred to as a "final gap GE") between the stator blades 8E that constitute the lowermost exhaust stage PTn and the thread groove exhaust portion stator 9, and an outlet (a downstream opening end) of the same thread groove exhaust flow path R is communicated with the outlet port 3 via a pump internal outlet port side flow path S.

The pump internal outlet port side flow path S is formed so as to reach the outlet port 3 from the outlet of the thread groove exhaust flow path R by providing a predetermined gap between lower end portions of the cylindrical portion 6 and the thread groove exhaust portion stator 9 and the inner bottom portion of the pump base 1B (in the vacuum pump P1 shown in FIG. 1, a gap of a mode that circumnavigates an outer circumference of a lower portion of the stator column 4).

Explanation of Exhaust Operation by Thread Groove Exhaust Portion

A gas particle having reached the final gap GE described above by being transferred by an exhaust operation of the plurality of exhaust stages PT described earlier moves to the thread groove exhaust flow path R. The moved gas particle moves toward the pump internal outlet port side flow path S while being compressed from a transitional flow into a viscous flow by a drag effect created by a rotation of the cylindrical portion 6. In addition, the gas particle having reached the pump internal outlet port side flow path S flows into the outlet port 3 and is exhausted to outside the housing case 1 through an auxiliary pump (not illustrated).

Explanation of Particle Transferring Portion

Figure 2:
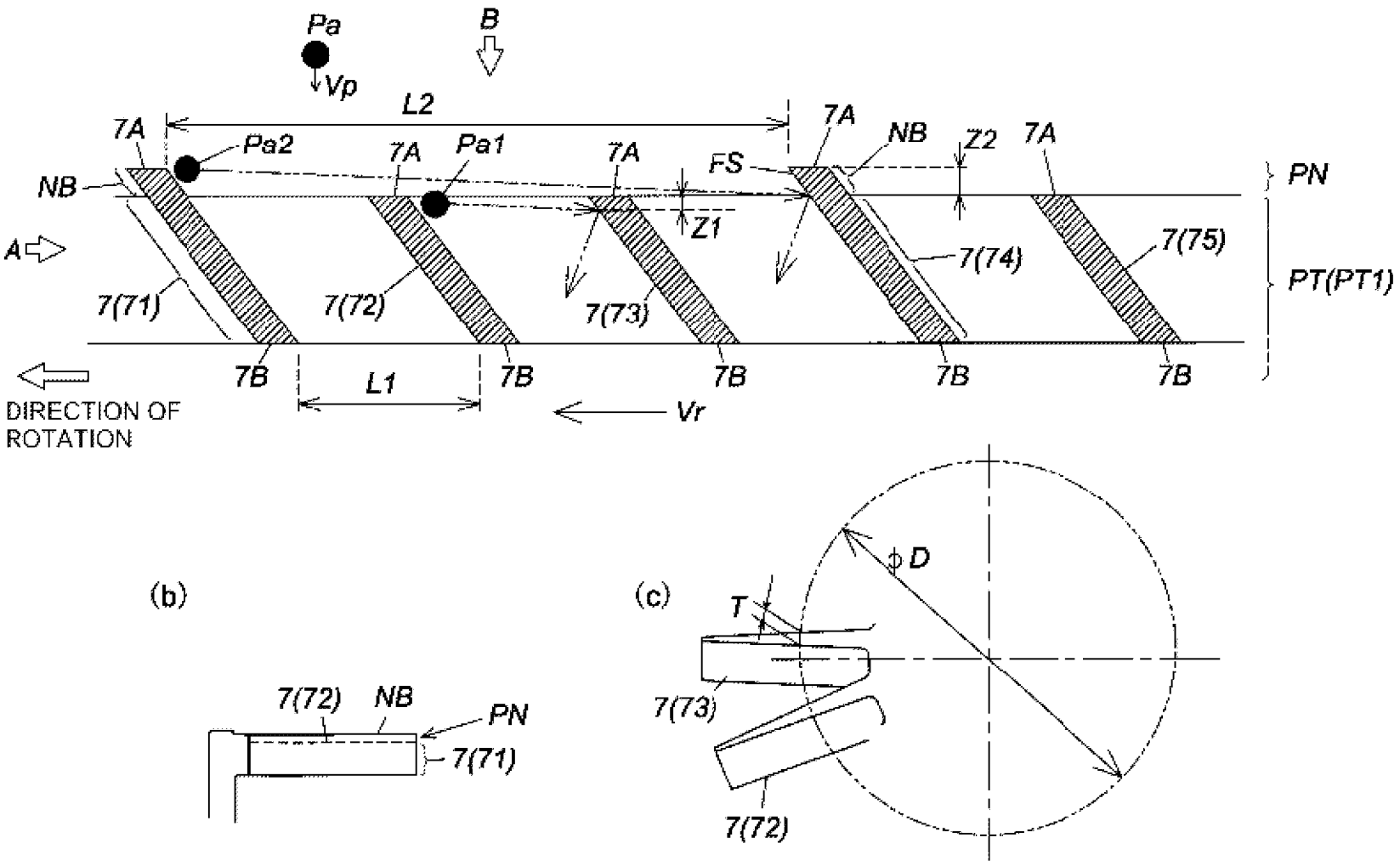
FIG. 2A is an explanatory view of a particle transferring portion in the vacuum pump shown in FIG. 1 in a state of being viewed from an outer circumferential surface side of a rotor.
FIG. 2B is an A-sagittal view of FIG. 2A.
FIG. 2C is a B-sagittal view of FIG. 2A.

FIG. 2A is an explanatory view of the uppermost exhaust stage PT (PT1) (including the particle transferring portion) in the vacuum pump shown in FIG. 1 in a state of being viewed from an outer circumferential surface side of the cylindrical portion, FIG. 2B is an A-sagittal view of FIG. 2A, and FIG. 2C is a B-sagittal view of FIG. 2A.

Referring to FIG. 2A, the particle transferring portion PN enables a particle to be transferred in an exhaust direction of a gas particle by increasing or reducing a height of an upstream end 7A of at least a part of rotor blades 7 (71 and 74) among the plurality of rotor blades 7 that constitute the uppermost exhaust stage PT (PT1) to realize a stepped structure in which heights of upstream ends 7A differ as the uppermost exhaust stage PT (PT1) as a whole.

While the example shown in FIG. 2A represents a configuration in which the upstream ends 7A of two rotor blades 71 and 74 positioned on both sides of two rotor blades 72 and 73 are higher than the upstream ends 7A of other rotor blades 72, 73, and 75, this configuration is not restrictive. The numbers of the rotor blade of which the upstream end 7A is high and rotor blades positioned therebetween may be increased or reduced as necessary, and there may be one rotor blade of which the upstream end 7A is high.

Hereinafter, for the purpose of illustration, a portion in which a height of an upstream end has been increased by the stepped structure among the plurality of rotor blades 7 that constitute the uppermost exhaust stage PT (PT1) will be referred to as a "blade high portion NB".

Figure 22:
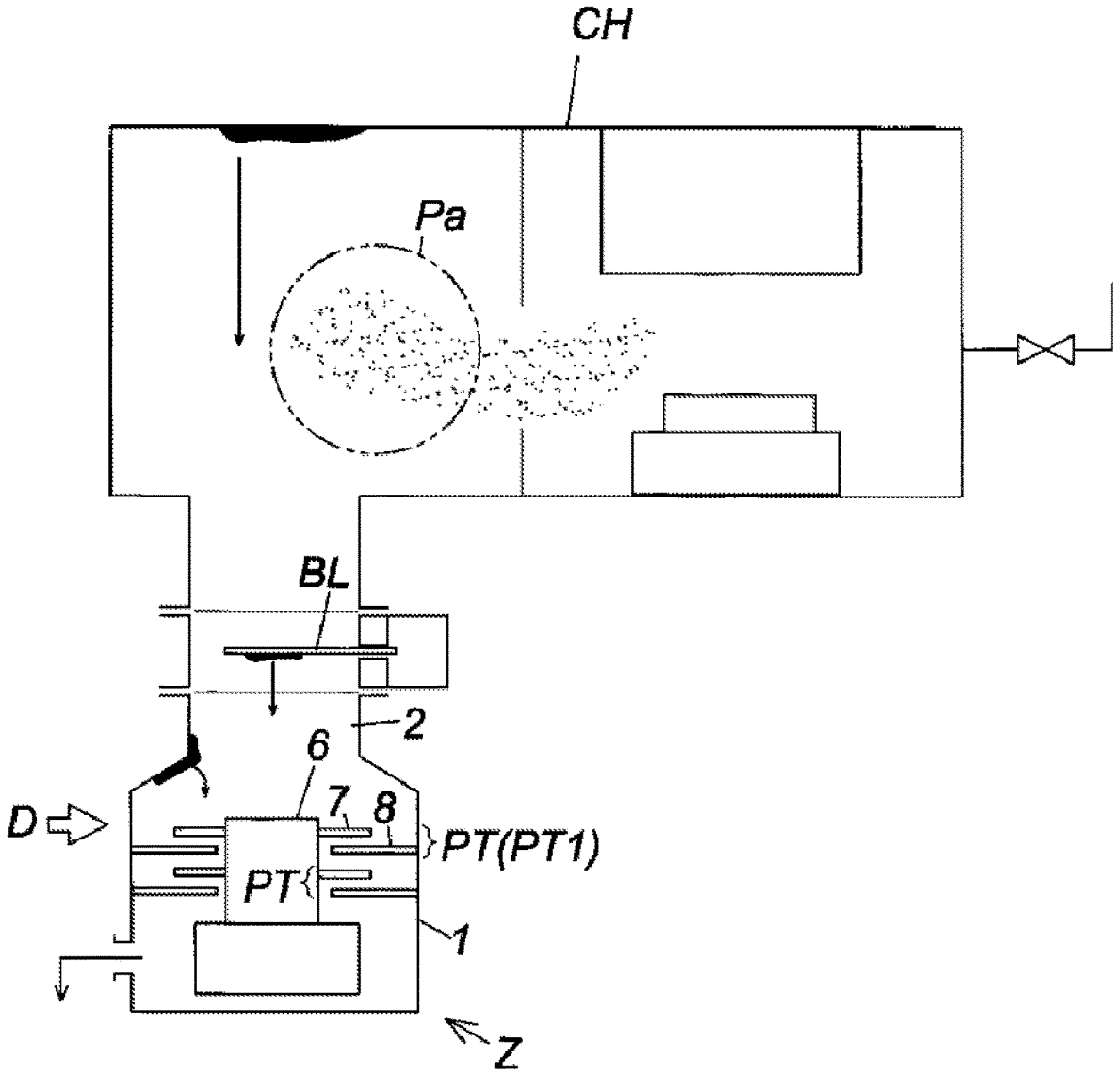
FIG. 22 is a schematic view of an exhaust system that adopts a conventional vacuum pump as a gas exhaust means of a vacuum chamber.

Referring to FIG. 22, it is assumed that a particulate process by-product that is secondarily produced by a chemical process in the vacuum chamber CH floats and disperses inside the vacuum chamber CH and falls toward the inlet port 2 of the vacuum pump P1 due to its own weight and a transfer effect created by a gas particle. It is also assumed that deposited material that is adhered to and deposited on an inner wall surface of the vacuum chamber CH, deposited material that is adhered to and deposited on a pressure control valve BL, and the like exfoliate due to vibration or the like and fall toward the inlet port 2 of the vacuum pump P1 due to their own weight.

Referring to FIG. 2A, a particle Pa having arrived at the inlet port 2 due to the fall described above further falls from the inlet port 2 and is initially incident to the particle transferring portion PN and collides with the blade high portion NB.

When classified by a direction of travel of a particle after collision, a plurality of particles that collide with the blade high portion NB can be roughly divided into exhaust direction-reflected particles and backflow particles. An exhaust direction-reflected particle is a particle that is reflected in a gas particle exhaust direction due to a collision with an inclined surface FS (hereinafter, referred to as a "blade high portion front inclined surface FS") of the blade high portion NB that is positioned on a front side in a direction of travel due to a rotation of the blade high portion NB. A backflow particle is a particle that ricochets in a direction of the inlet port 2.

In the uppermost exhaust stage PT (PT1), providing the particle transferring portion PN increases a ratio of exhaust direction-reflected particles and reduces a ratio of backflow particles. A reason therefor is as described in "Consideration" below.

Consideration

Figure 3:
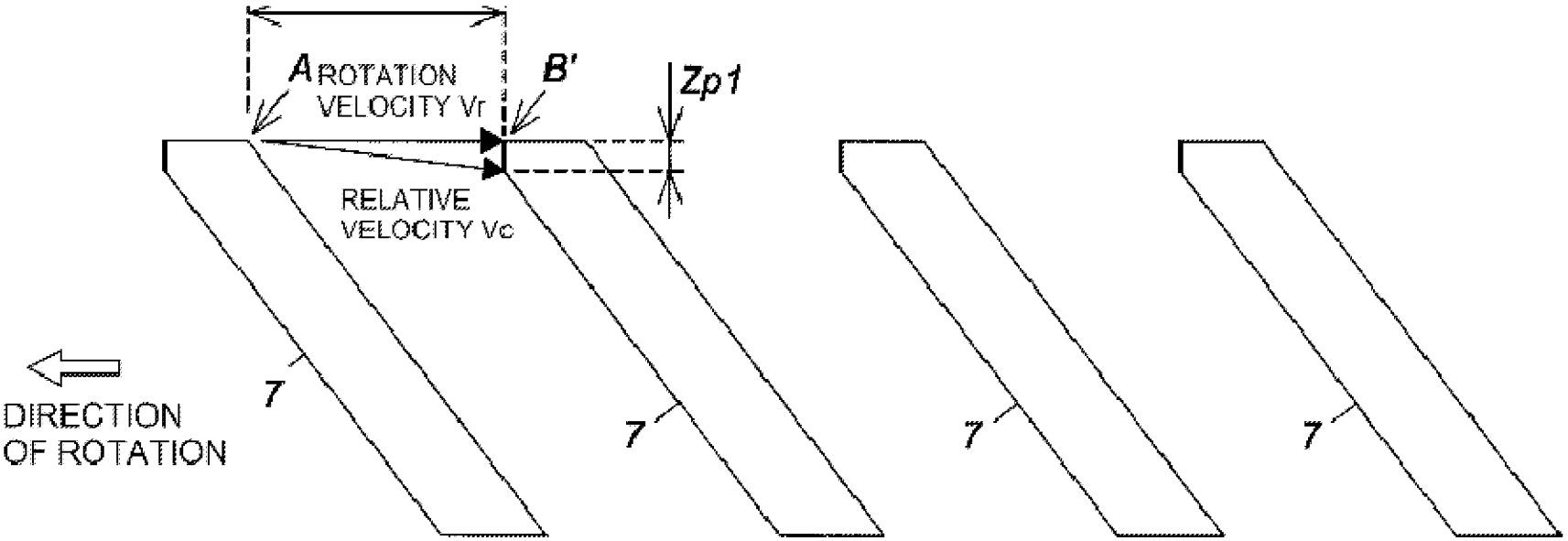
FIG. 3 is an explanatory view of a collision-enabled region of a particle that falls in a vacuum pump not provided with a particle transferring portion.
Figure 4:
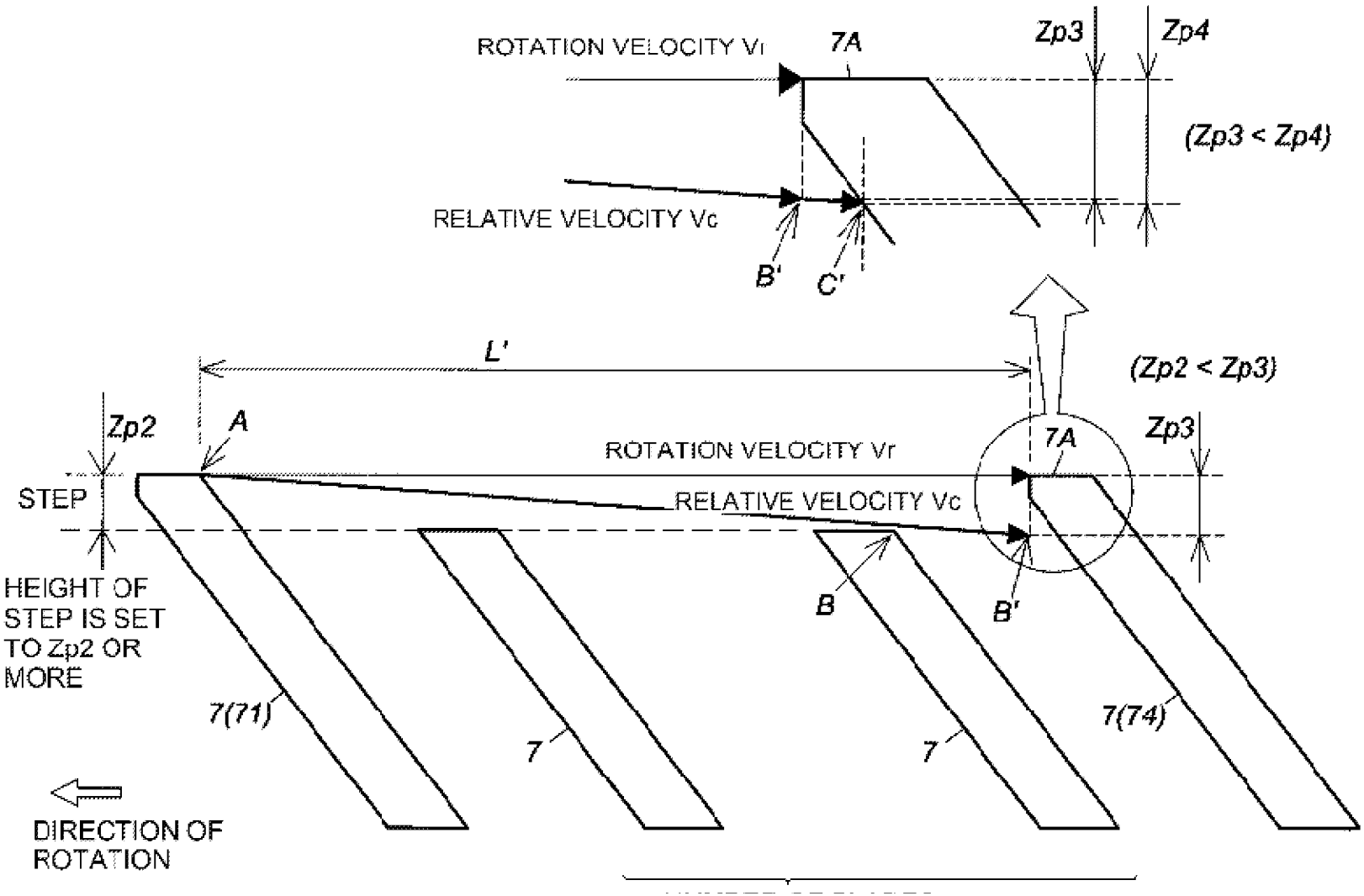
FIG. 4 is an explanatory view of a collision-enabled region of a particle that falls in the vacuum pump shown in FIG. 1 which is provided with a particle transferring portion.

FIG. 3 is an explanatory view of a collision-enabled region of a particle that falls in a vacuum pump not provided with a particle transferring portion, and FIG. 4 is an explanatory view of a collision-enabled region of a particle that falls in the vacuum pump shown in FIG. 1 which is provided with a particle transferring portion.

Referring to FIG. 3, in the case of the vacuum pump not provided with a particle transferring portion, a collision-enabled region Zp1 of a particle in a diameter D portion (refer to FIG. 2C) of the uppermost exhaust stage PT (PT1) is obtained by expression (3) below.

$$Zp1=\{(\pi D/N-T)Vp\}/(Vr) \quad \text{expression (3)}$$

N: number of rotor blades 7 constituting uppermost exhaust stage PT (PT1)

D: dimension of diameter D portion (refer to FIG. 2C)

T: thickness perpendicular to shaft in diameter D portion of rotor blades 7 constituting uppermost exhaust stage PT (PT1) (refer to FIG. 2C)

Vp: fall velocity of particle

Vr: rotation velocity (circumferential velocity) of rotor blades 7 in diameter D portion Referring to FIG. 4, a height (a protrusion height) Zp2 of a step in the stepped structure is specified based on expression (4) below.

Expression (4) below considers the two rotor blades 72 and 73 in FIG. 2A as n-number of rotor blades 7 as shown in FIG. 3 and is applied to a stepped structure in which the upstream ends 7A of the rotor blades 71 and 74 being positioned on both sides of the n-number of rotor blades 7 are made higher than the upstream ends of the other rotor blades (other than 71 and 74).

$$Zp2=\{(\pi D\cdot n/N)Vp\}/(Vr) \quad \text{expression (4)}$$

n: number of rotor blades positioned between rotor blades 71 and 74 with high upstream ends D: dimension of diameter D portion (refer to FIG. 2C)

N: number of rotor blades 7 constituting uppermost exhaust stage PT (PT1)

Vp: fall velocity of particle Pa

Vr: rotation velocity (circumferential velocity) of rotor blades 7 in diameter D portion In the diameter D portion shown in FIG. 2C, by making a step between the n-number of rotor blades 7 and the rotor blades (71 and 74) positioned on both sides thereof equal to or greater than Zp2 as shown in FIG. 4, a particle fallen into a space (corresponding to L2 in FIGS. 2A to 2C) between the rotor blades with reference numerals 71 and 74 is to collide with a front surface of the rotor blade with the reference numeral 74 without colliding with the n-number of rotor blades 7. In addition, a collision-enabled region of a particle to a front surface of the rotor blade with the reference numeral 74 is specified by Zp3 in expression (5) below.

In this consideration, a rotor blade of which an upstream end is higher by the height Zp2 of the blade high portion NB is considered to exist in the uppermost exhaust stage PT (PT1).

When considered as described above, a collision-enabled region Zp3 (refer to FIG. 4) of a particle in the diameter D portion (refer to FIG. 2C) in the uppermost exhaust stage PT (PT1) is specified based on expression (5) below.

$$Zp3=[\{\pi D(n+1)/N-T)\}Vp]/(Vr) \quad \text{expression (5)}$$

N: number of rotor blades 7 constituting uppermost exhaust stage PT (PT1)

D: dimension of diameter D portion (refer to FIG. 2C)

T: thickness perpendicular to shaft in diameter D portion of rotor blades 7 constituting uppermost exhaust stage PT (PT1) (refer to FIG. 2C)

Vp: fall velocity of particle

Vr: rotation velocity (circumferential velocity) of rotor blades 7 in diameter D portion n: number of rotor blades positioned between rotor blades 71 and 74 with high upstream ends Referring to FIG. 4, a relative velocity Vc of a particle as viewed from the rotor blades 7 is obtained from the rotation velocity Vr of the rotor blades 7 in the diameter D portion (refer to FIGS. 2A to 2C) and the fall velocity Vp of the particle. In FIG. 4, if an interval or a section of the rotor blades 7 (71 and 74) with high upstream ends is denoted by a blade interval L', then a particle incident from a point A in FIG. 4 (a particle capable of being incident (falling) to a most downstream side in the blade interval L') falls to a point B' that is positioned on an extension of a tip of the rotor blade 7 (74) within a range of the blade interval L'. A fall distance from an upper end surface 7A of the rotor blade 7 (74) to the point B' is Zp3 obtained by expression (5) described earlier. In the vacuum pump shown in FIG. 1 that is provided with the blade high portion NB (corresponding to the vacuum pump according to the present invention), since a blade surface such as a chamfered surface is not present within the range of Zp3, the particle having fallen to the point B' is capable of falling further and finally collides with a front surface of the rotor blade 7 (74) or, more specifically, a point C' on a downward inclined surface of the rotor blade 7 (74).

As will be appreciated from the foregoing, in the vacuum pump shown in FIG. 1 that is provided with the particle transferring portion PN, a fall distance Zp4 of the particle from the upper end surface 7A of the rotor blade 7 (74) to the point C' is a collision-enabled region of the particle, and the collision-enabled region (the fall distance Zp4) is greater than the collision-enabled region Zp3 obtained from expression (5) described earlier.

In essence, while a particle incident from the point A in FIG. 4 collides with the point B when a height of a step due to the stepped structure is set to Zp2, by making the step Zp2 or higher, the particle avoids colliding with the n-number of rotor blades 7 and collides with the front surface of the rotor blade 7 (74) (for example, the point C' on the downward inclined surface of the rotor blade 7 (74)).

Expression (3) described earlier and expression (5) described earlier will now be comparatively reviewed. In doing so, when ignoring a thickness T of the rotor blade 7 in expression (3) and expression (5) for the sake of brevity, since adopting a stepped structure in which a height of a step is Zp2 or higher as described above or, in other words, adopting expression (5) expands a collision-enabled region of the particle Pa by (n+1) times as compared to adopting expression (3), a ratio of exhaust direction-reflected particles increases while a ratio of backflow particles decreases. The reason therefor is that, in essence, when a collision-enabled region of a particle expands, a probability of colliding with an inclined surface that is inclined toward the gas particle exhaust direction among the rotor blade 7 or the blade high portion NB and being reflected in the gas particle exhaust direction becomes more dominant than a probability of colliding with a surface that has a probability of causing the particle to flow back in the direction of the inlet port 2.

Explanation of Configuration for Correcting Imbalance of Rotating Body as a Whole In the vacuum pump P1 shown in FIG. 1, a rotating body R is constituted by the plurality of rotor blades 7, the particle transferring portion PN, and the cylindrical portion 6 that supports the plurality of rotor blades 7, and since the blade high portion NB is provided so as to be point symmetric with respect to the rotating shaft 5 of the rotating body R as an axis of point symmetry, a balance of the rotating body R as a whole is maintained. In other words, the rotating body R as a whole is rotationally symmetric around the rotating shaft 5.

An operational effect of the particle transferring portion PN of reducing the ratio of backflow particles described above is sufficiently exhibited even when there is only one rotor blade 7 (74) of which the height of the upstream end 7A has been increased by the stepped structure (hereinafter, referred to as a "high blade 7 (74)"). However, in this case, the presence of the high blade 7 (74) (specifically, a mass of the blade high portion NB) prevents the rotating body R as a whole from attaining rotational symmetry around the rotating shaft 5 and an imbalance is created in the rotating body R as a whole. In addition, even when such a high blade is present in plurality, an imbalance of the rotating body R as a whole is created unless the plurality of high blades are point symmetric around the rotating shaft 5 of the rotating body R as an axis of point symmetry.

Figure 5:
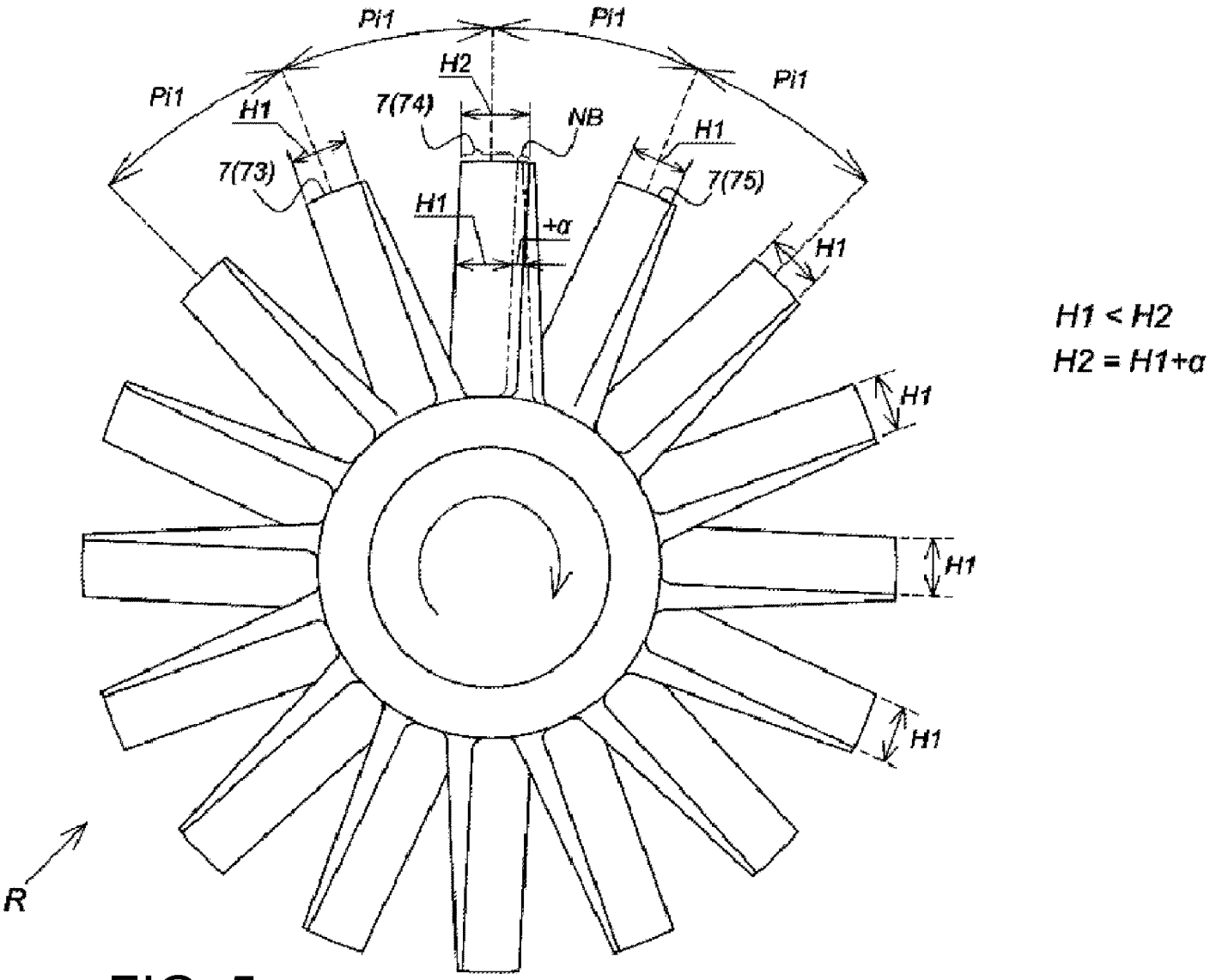
FIG. 5 is a top view of a rotating body before correcting an imbalance.
Figure 6:
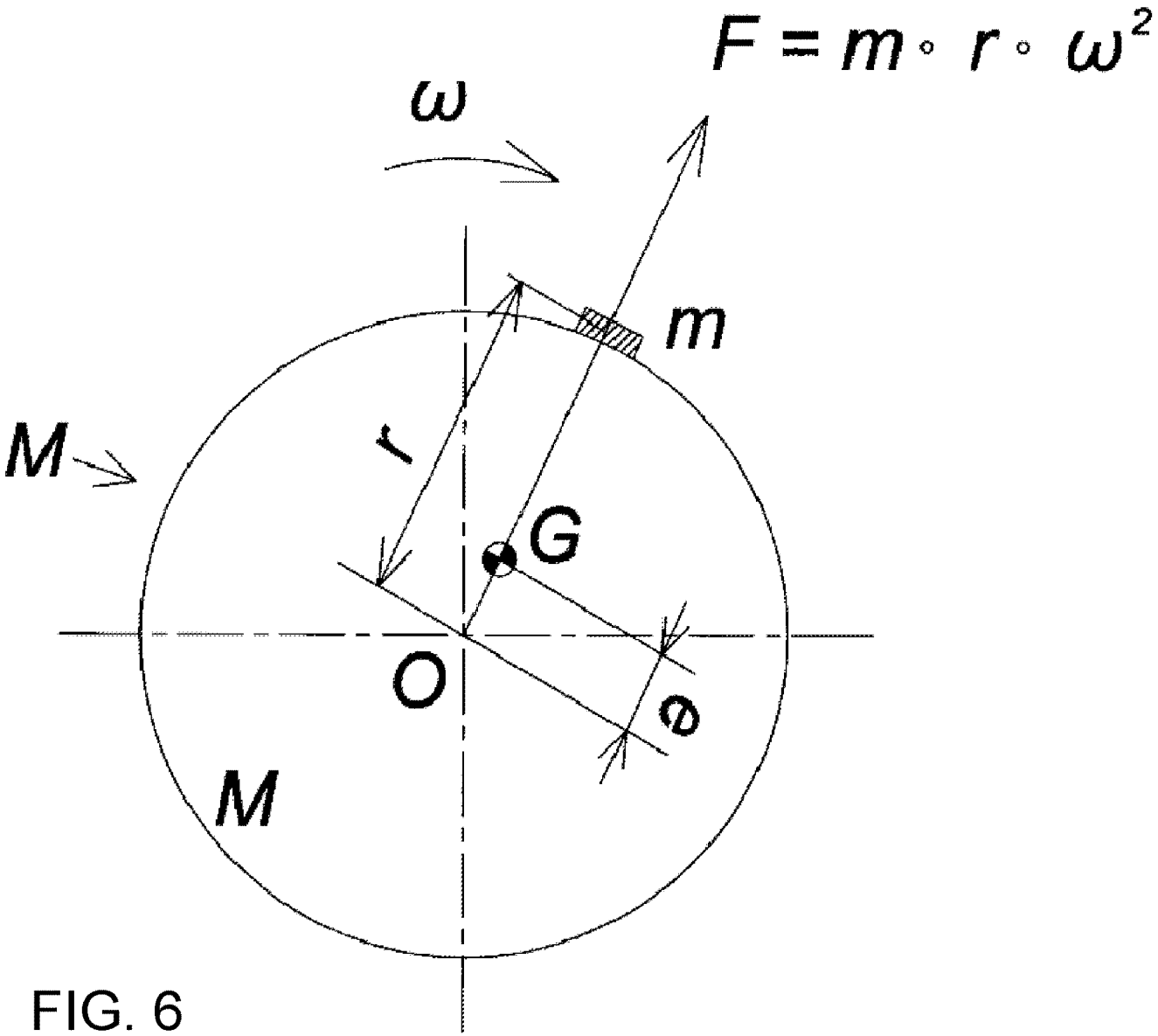
FIG. 6 is an explanatory view of a basic idea of correcting an imbalance of a rotating body as a whole.

FIG. 5 is a top view of a rotating body before correcting an imbalance, and FIG. 6 is an explanatory view of a basic idea of correcting an imbalance of a rotating body as a whole.

In FIG. 6, a reference character "M" denotes a mass of the rotating body R as a whole excluding the blade high portion NB, a reference character "m" denotes a mass of the blade high portion NB, a reference character "O" denotes a center of rotation of the rotating body R, a reference character "G" denotes a center of gravity of the rotating body R as a whole including the blade high portion NB, and a reference character "e" denotes a distance from the center of gravity to the center of rotation of the rotating body. In addition, a reference character "r" denotes a distance from the center of rotation O of the rotating body to a center of gravity of the blade high portion NB alone, a reference character "ω" denotes a rotational angular velocity of the rotating body R, and a reference character "F" denotes a centrifugal force created by an increase in mass due to the blade high portion NB. The centrifugal force F can be expressed as $m \cdot r \cdot \omega^2$.

A basic idea of correcting an imbalance of the rotating body R as a whole involves setting a balance of the rotating body R as a whole while taking the centrifugal force F ($=m \cdot r \cdot \omega^2$) described above into consideration.

When an imbalance of the rotating body R as a whole is created in the vacuum pump P1 shown in FIG. 1, first to seventh imbalance correcting structures described later can be adopted in consideration of the centrifugal force F. It should be noted that the first to seventh imbalance correcting structures may be adopted either independently or in combination.

Explanation of First Imbalance Correcting Structure

The first imbalance correcting structure is configured to correct the imbalance by removing a part of the high blade 7 (74) or the rotor blades (73 and 75) that are proximal thereto.

Figure 7:
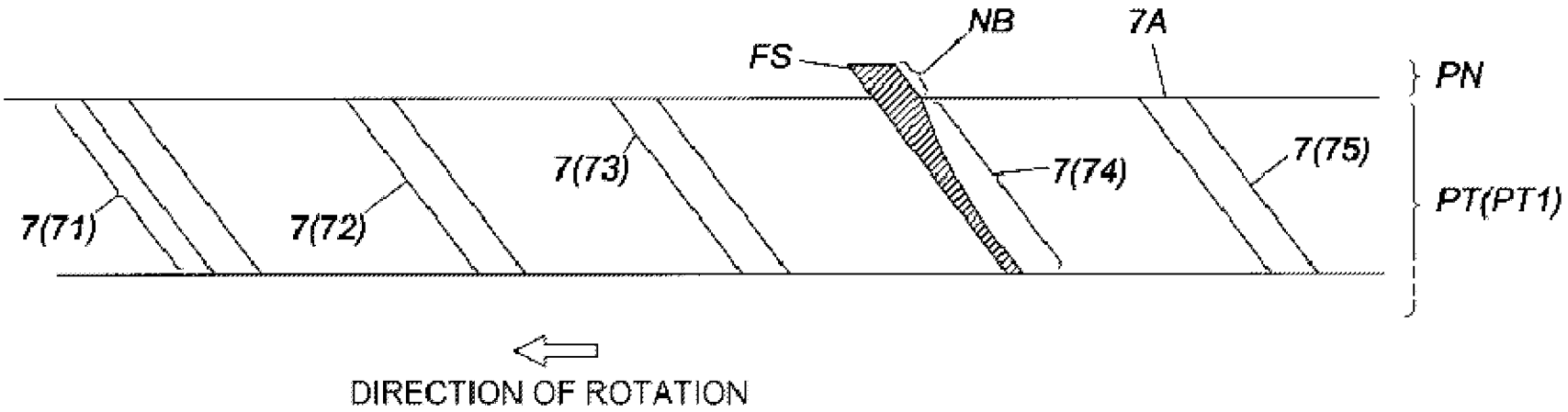
FIG. 7 is an explanatory view of a first imbalance correcting structure.
Figure 8:
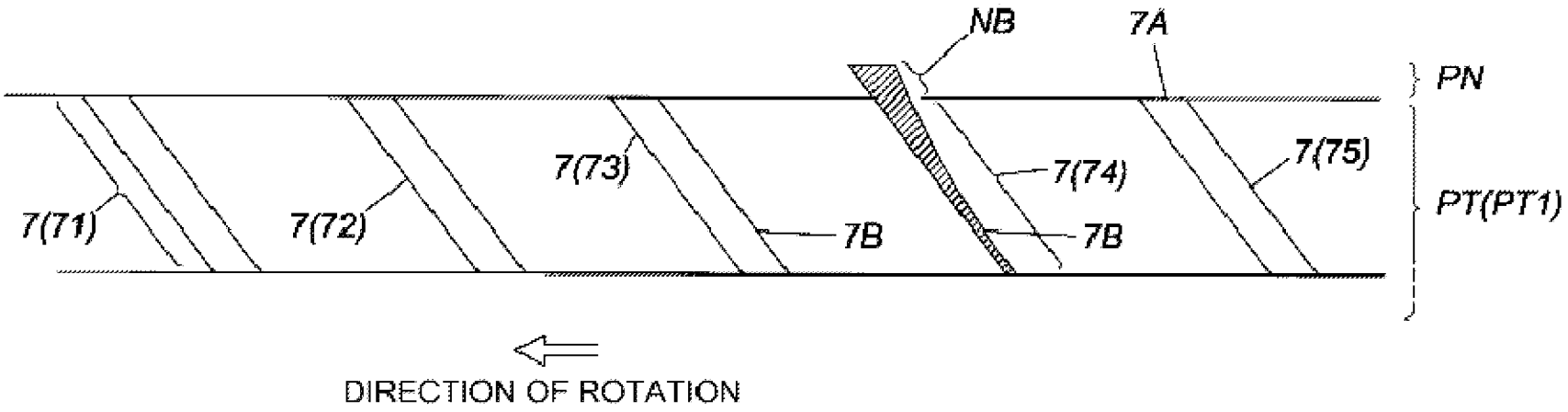
FIG. 8 is an explanatory view of the first imbalance correcting structure.

As shown in FIGS. 7 and 8, the removal of the part may involve removing a predetermined amount on a rear surface 7B side in the direction of rotation that contributes less to exhaust of a gas particle among an entire blade surface of the high blade 7 (74). In addition, a rear surface side of a rotor blade in proximity to the high blade 7 (74) may be removed by a predetermined amount.

While the rear surface 7B is shaved off so as to resemble an arc surface in the example shown in FIGS. 7 and 8, this is not restrictive. In addition, an amount by which the rear surface 7B is shaved or a position at which the rear surface 7B is shaved can be appropriately changed if necessary. A shaved range of the rear surface 7B may include the blade high portion NB as shown in FIG. 8 or may not include the blade high portion NB as shown in FIG. 7.

Figure 9:
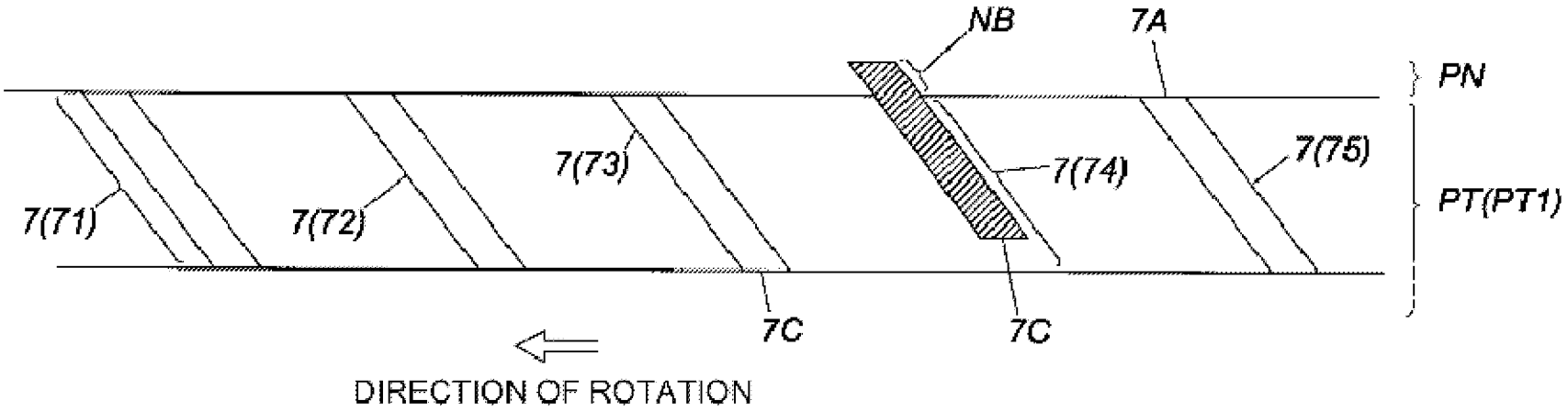
FIG. 9 is an explanatory view of the first imbalance correcting structure.

The removal of the part may involve removing a predetermined amount of a downstream end edge 7C of the high blade 7 (74) as shown in FIG. 9. In addition, the downstream end edge 7C of a rotor blade in proximity to the high blade 7 (74) may be cut by a predetermined amount.

While the downstream end edge 7C of the high blade 7 (74) is removed in an amount corresponding to a length of the blade high portion NB in the example shown in FIG. 9, the amount of removal can be appropriately changed if necessary.

Figure 10:
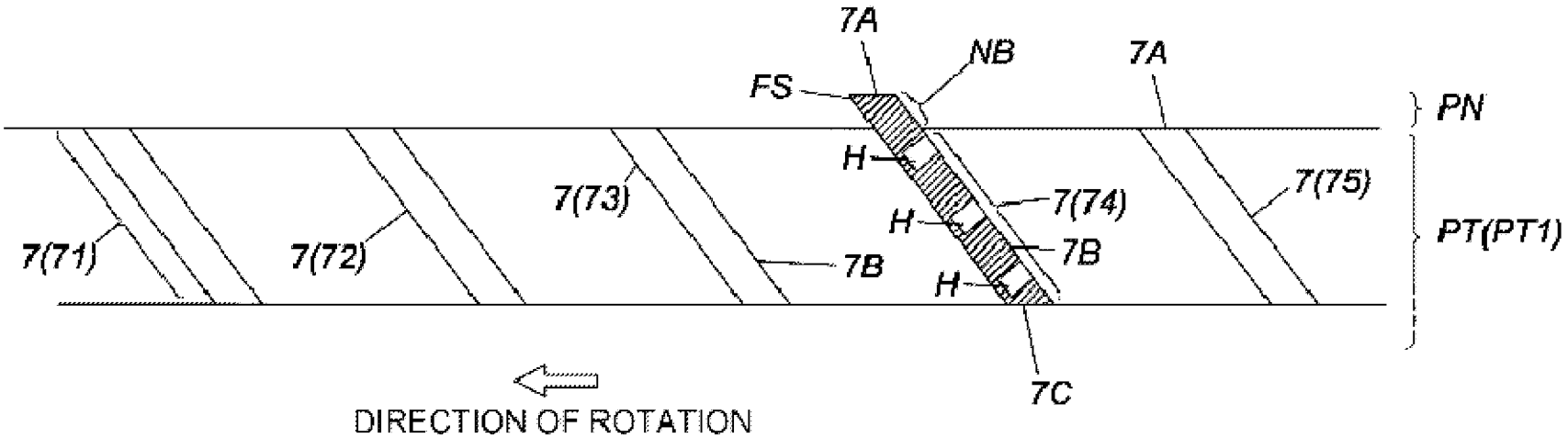
FIG. 10 is an explanatory view of the first imbalance correcting structure.

The removal of the part may involve forming a hole H in the high blade 7 (74) as shown in FIG. 10. In addition, a hole may be formed in a rotor blade in proximity to the high blade 7 (74).

While the hole H (specifically, a blind hole) is formed in plurality at predetermined intervals along a direction from the upstream end 7A to the downstream end 7C of the rotor blade 7 (74) in the example shown in FIG. 10, this is not restrictive. For example, the hole H may be formed in plurality along a radial direction of the high blade (74) (a same direction as a radial direction of the cylindrical portion 6; hereinafter, the same description will apply). The number and formation positions of the hole H can be appropriately changed if necessary. This similarly applies to a case where a hole is formed in a rotor blade in proximity to the high blade 7 (74).

Figure 11:
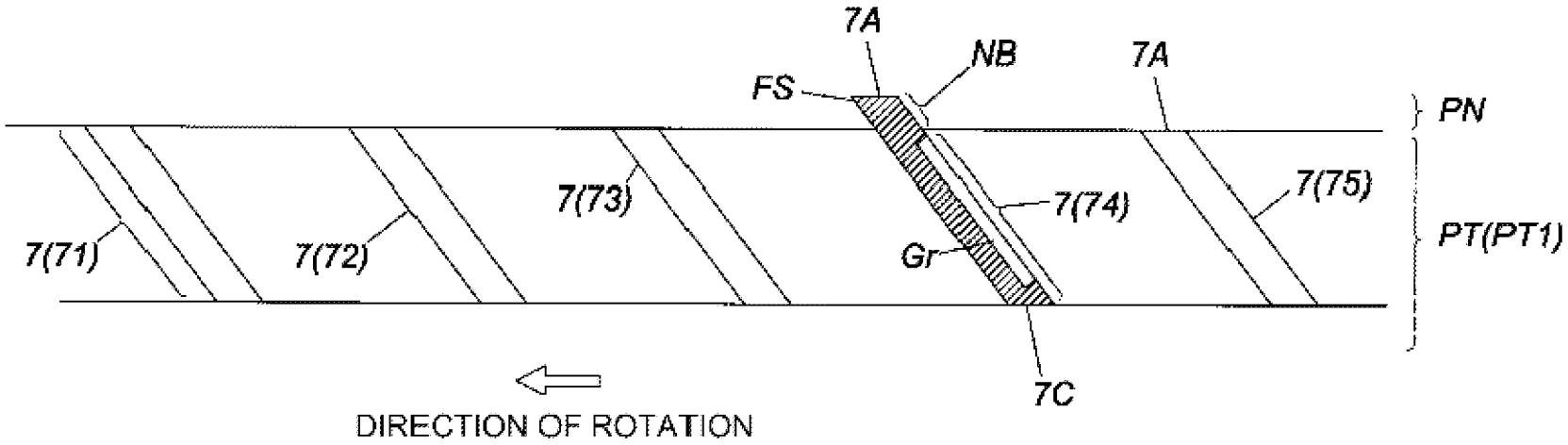
FIG. 11 is an explanatory view of the first imbalance correcting structure.

The removal of the part may involve forming a groove Gr in the high blade 7 (74) as shown in FIG. 11. In addition, a groove may be formed in a rotor blade in proximity to the high blade 7 (74).

While a longitudinally long groove Gr along the direction from the upstream end 7A to the downstream end edge 7C of the high blade 7 (74) is formed on a rear surface side of the high blade 7 (74) in the example shown in FIG. 11, this is not restrictive. The shape, length, and number of the groove Gr can be appropriately changed if necessary.

For example, the groove Gr may be formed along a radial direction of the rotor blade 7 (74) so as to take a laterally long shape, or a combination of a groove with such a laterally long shape and the groove Gr with the longitudinally long shape described above may be adopted. This similarly applies to a case where a groove is formed in a rotor blade in proximity to the high blade 7 (74).

Furthermore, although not illustrated, the removal of the part may involve forming the high blade 7 (74) or the rotor blades that are proximal thereto so that a length in a radial direction thereof is shorter than a length in a radial direction of other standard rotor blades 7. In this case, a length to be shortened can be appropriately changed if necessary.

Figure 12:
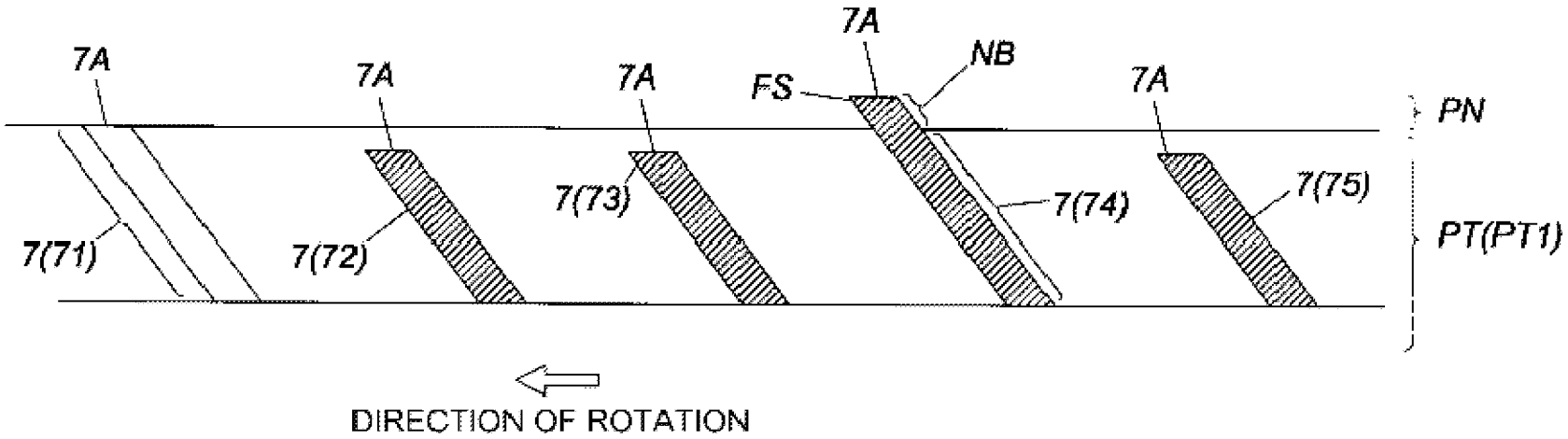
FIG. 12 is an explanatory view of the first imbalance correcting structure.
Figure 13:
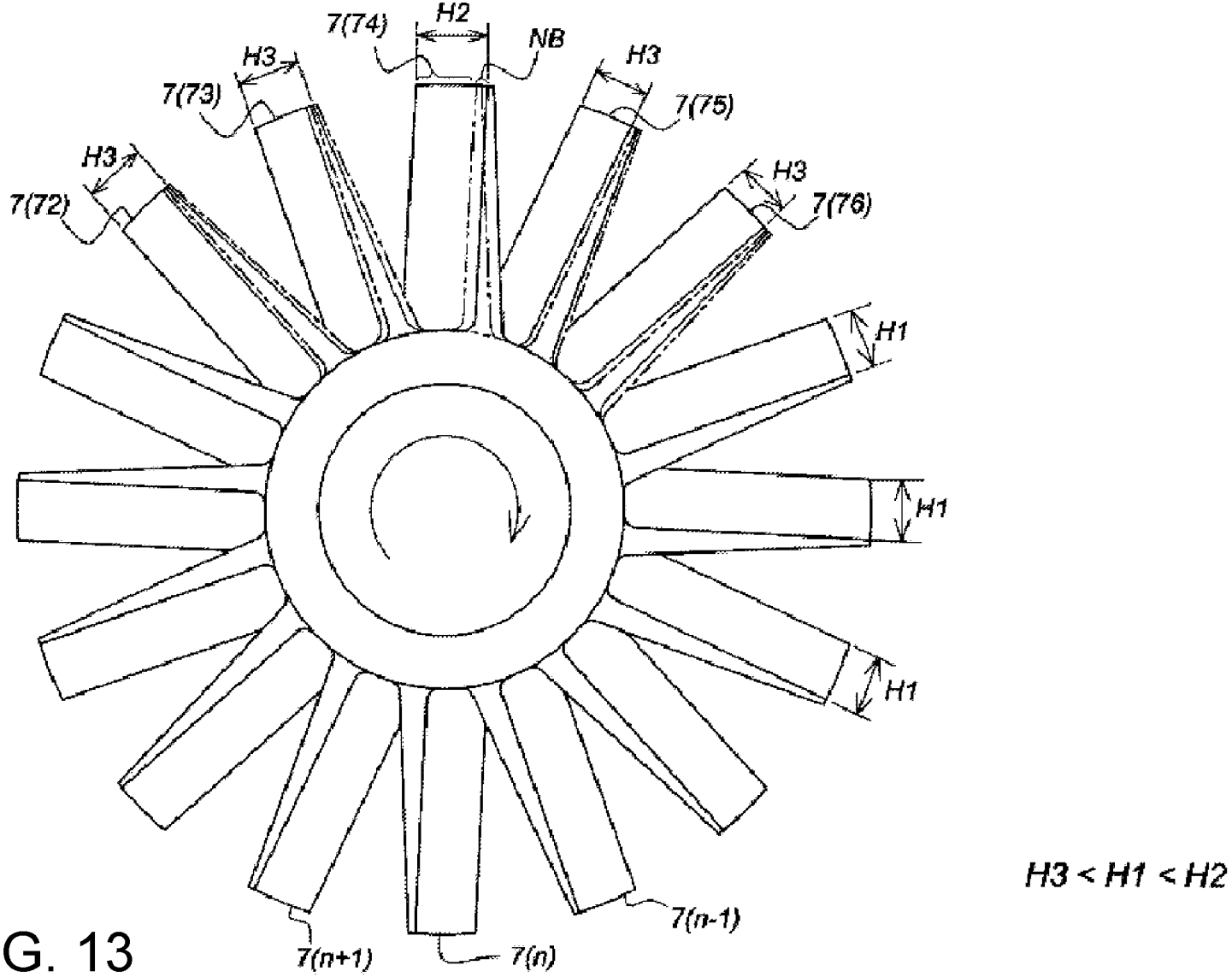
FIG. 13 is a top view of a rotating body to which the first imbalance correcting structure shown in FIG. 12 is applied.

In addition, the removal of the part may involve removing a predetermined amount of an upstream end 7A of the rotor blades 7 that are proximal to the high blade 7 (74) as shown in FIGS. 12 and 13.

Reference character "H2" in FIGS. 13 and 5 denotes a height of the rotor blade 7 (74) provided with the particle transferring portion PN, reference character "H3" in FIG. 13 denotes a height of the rotor blades 7 (72, 73, and 75) that are proximal to the rotor blade 7 (74), and reference character "H1" in FIGS. 13 and 5 denotes a height of other standard rotor blades.

Figure 15:
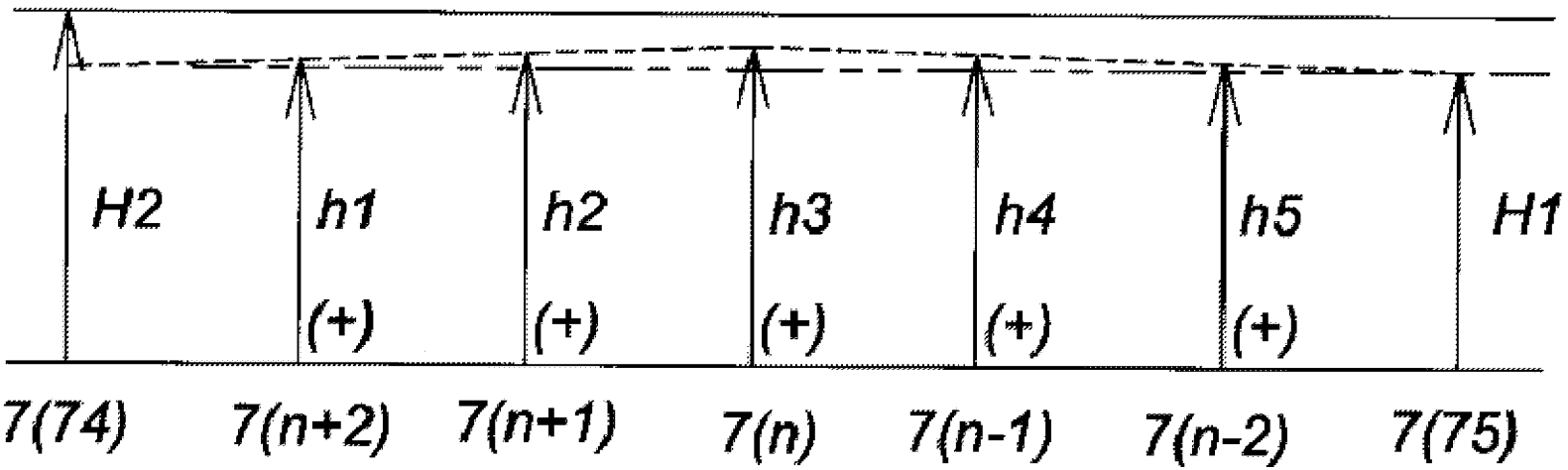
FIG. 15 is an explanatory view of the second imbalance correcting structure.

As is apparent from a comparison of the heights (H3<H1<H2) and a comparison to FIGS. 13 and 15, while the upstream ends 7A of a total of four left and right rotor blades 7 (72, 73, 75, and 76) that are proximal to the high blade 7 (74) have been removed by a predetermined amount in the example shown in FIGS. 12 and 13, this is not restrictive. The number of rotor blades 7 of which the upstream end 7A is to be cut and a length by which the upstream end 7A is to be cut can be appropriately changed if necessary.

Explanation of Second Imbalance Correcting Structure (Counter Balance)

Figure 14:
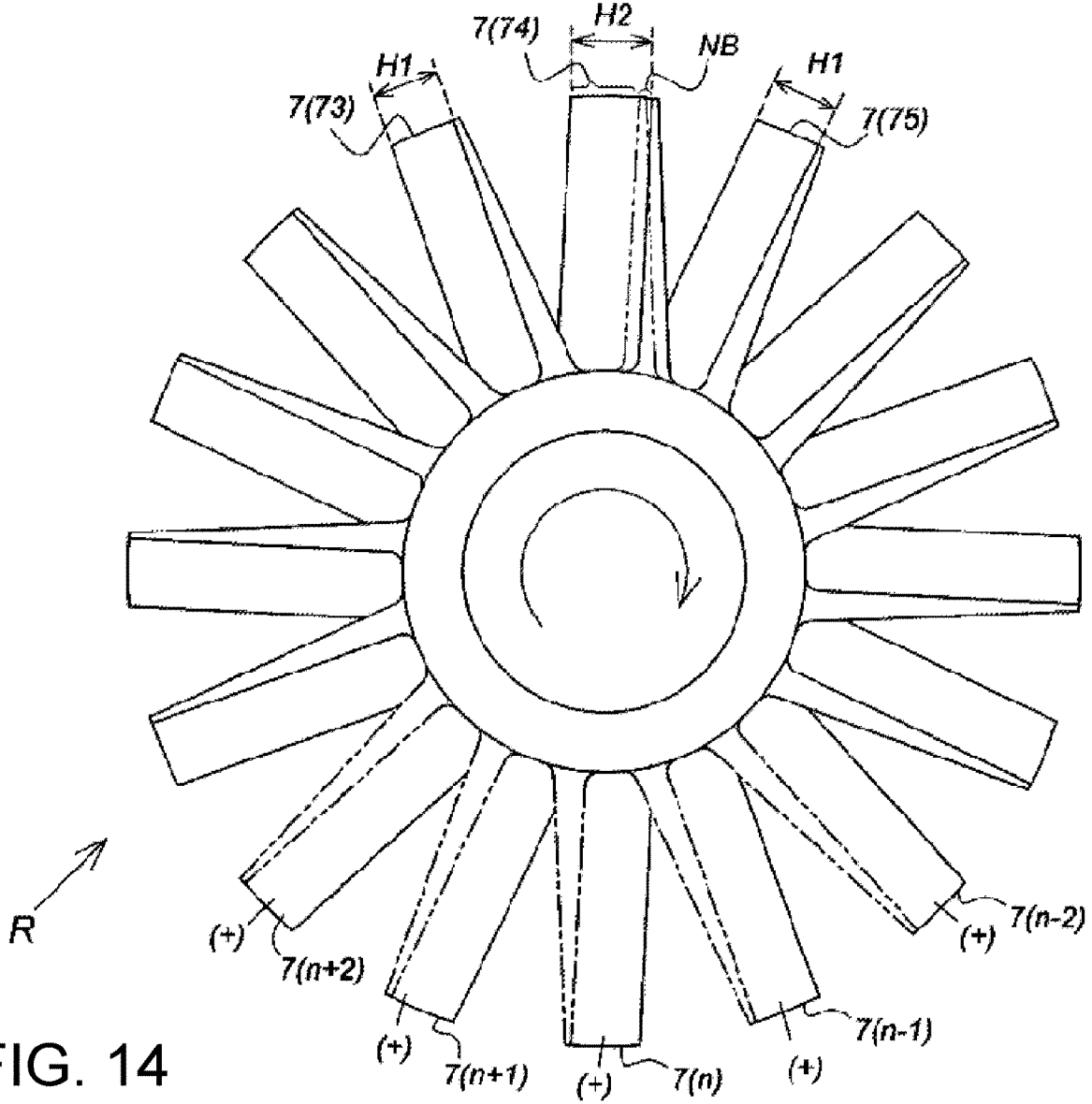
FIG. 14 is an explanatory view of a second imbalance correcting structure.

FIG. 14 is an explanatory view of a second imbalance correcting structure (counter balance).

In the second imbalance correcting structure, as shown in FIG. 14, the imbalance described earlier is corrected by adding a predetermined mass to a rotor blade in a point symmetric relationship with the high blade 7 (74) with the rotating shaft 5 of the rotating body R as an axis of point symmetry or, in other words, a rotor blade 7($n$) positioned on an opposite side with respect to a center of rotation of the high blade 7 (74) or rotor blades 7($n$−2), 7($n$−1), 7($n$+1), and 7($n$+2) that are proximal to the rotor blade 7($n$).

The predetermined mass refers to a mass (hereinafter, referred to as a "corresponding mass") for creating a centrifugal force that cancels out the centrifugal force F described earlier (for example, a centrifugal force with a same magnitude but an opposite orientation to F). In FIG. 14, a sign (+) is attached to the rotor blade 7 to which a corresponding mass is to be added.

Hereinafter, for the purpose of illustration, the rotor blade 7($n$) positioned on the opposite side with respect to a center of rotation of the high blade 7 (74) will be referred to as a "symmetric blade" and a plurality of rotor blades 7($n$−2), 7($n$−1), 7($n$+1), and 7($n$+2) that are positioned on both sides of the symmetric blade 7($n$) will be referred to as "symmetric proximal blades".

Referring to FIG. 14, since a mass m of the blade high portion NB is present in the high blade 7 (74), the imbalance described earlier may be corrected by adding a corresponding mass to the symmetric blade 7($n$), adding the corresponding mass to the symmetric proximal blades 7($n$−2), 7($n$−1), 7($n$+1), and 7($n$+2) in a distributed manner, or adding the corresponding mass to both the symmetric blade 7($n$) and the symmetric proximal blades 7($n$−2), 7($n$−1), 7($n$+1), and 7($n$+2) in a distributed manner.

As a specific configuration for adding the corresponding mass described above, although not illustrated, a configuration in which the downstream end edge 7C of the symmetric blade 7(*n*) or the symmetric proximal blades 7(*n*−2), 7(*n*−1), 7(*n*+1), and 7(*n*+2) is extended longer than other rotor blades 7 may be adopted as a first configuration example, a configuration in which a length in a radial direction of the symmetric blade 7(*n*) or the symmetric proximal blades 7(*n*−2), 7(*n*−1), 7(*n*+1), and 7(*n*+2) is set longer than other rotor blades 7 may be adopted as a second configuration example, a configuration in which a thickness of the symmetric blade 7(*n*) or the symmetric proximal blades 7(*n*−2), 7(*n*−1), 7(*n*+1), and 7(*n*+2) is increased as compared to other rotor blades 7 may be adopted as a third configuration example, or a combination of these configurations may be adopted.

As shown in FIG. 14, when the corresponding mass is added to the symmetric blade 7(*n*) and the symmetric proximal blades 7(*n*−2), 7(*n*−1), 7(*n*+1), and 7(*n*+2) in a distributed manner, for example, a configuration may be adopted as shown in FIG. 15 in which the height of the upstream end 7A of the symmetric blade 7(*n*) and the symmetric proximal blades 7(*n*−2), 7(*n*−1), 7(*n*+1), and 7(*n*+2) is increased or reduced as represented by expression (6) below or expression (7) below within a range not exceeding the height H2 of the high blade 7 (74).

It should be noted that, for the purpose of illustration, blade heights are compared in expression (6) below using reference characters assigned to the respective blades and blade heights are compared in expression (7) below using reference characters denoting heights of the respective blades, and both expressions have the same meaning.

$$7(75)<\{7(n+2)=7(n-2)\},\{7(n+1)=7(n-1)\},7(n)<7(74) \quad \text{expression(6)}$$

$$H1<\{h1=h5\},\{h2=h4\},h3<H2 \quad \text{expression (7)}$$

While FIG. 15 shows 7(75)<{7(*n*+2)=7(*n*−2)}<{7(*n*+1)=7(*n*−1)}<7(74) as a specific example of expression (7) above and H1<{h1=h5}<{h2=h4}<H2 as a specific example of expression (6) above, these specific examples are not restrictive. A magnitude relationship among h1(=h5), h2(=h4), and h3 and a magnitude relationship among {7(*n*+2)=7(*n*−2)}, {7(*n*+1)=7(*n*−1)}, and 7(*n*) are arbitrary and can be appropriately changed if necessary.

Explanation of Third Imbalance Correcting Structure

Figure 16:
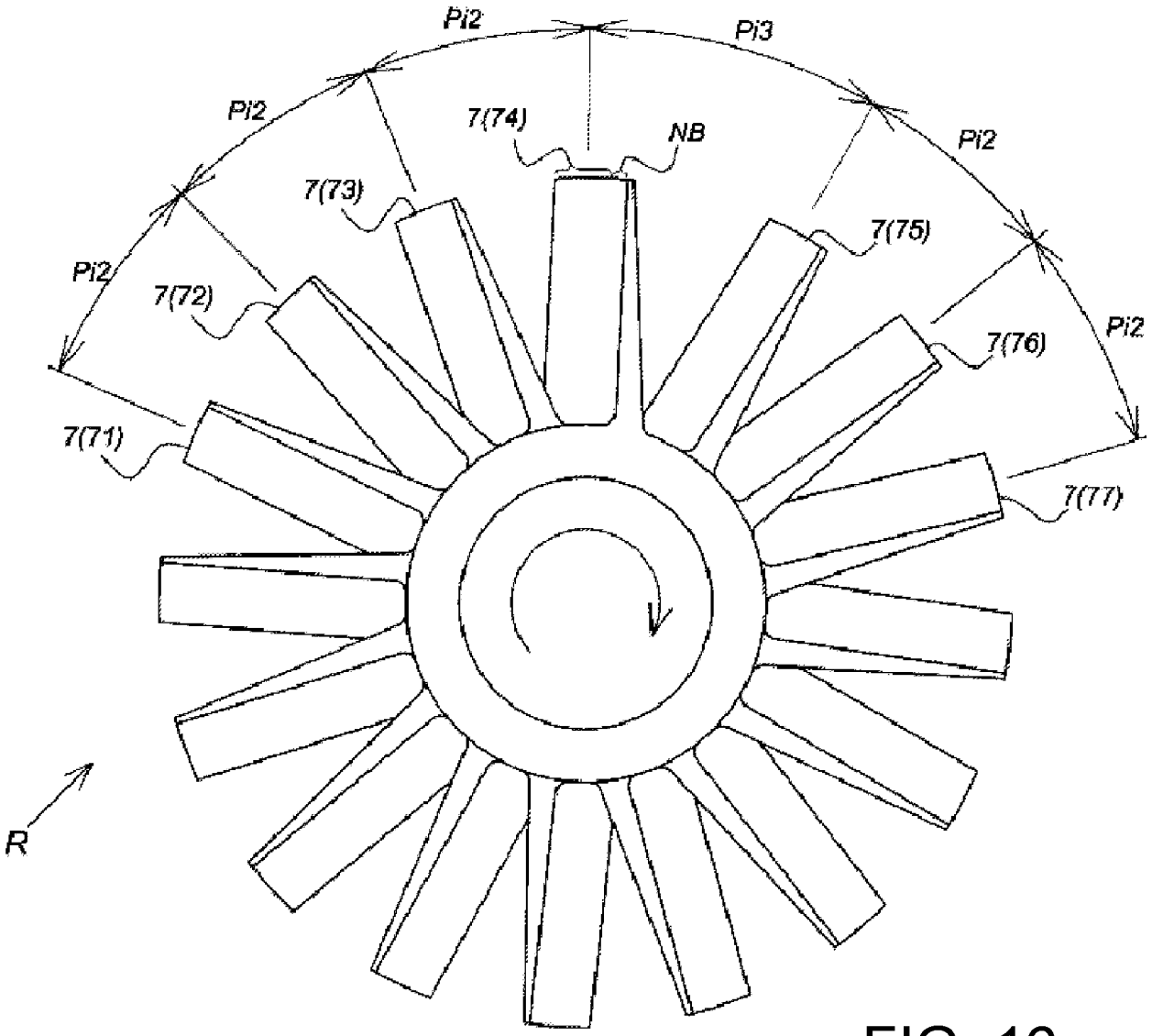
FIG. 16 is an explanatory view of a third imbalance correcting structure.
Figure 17:
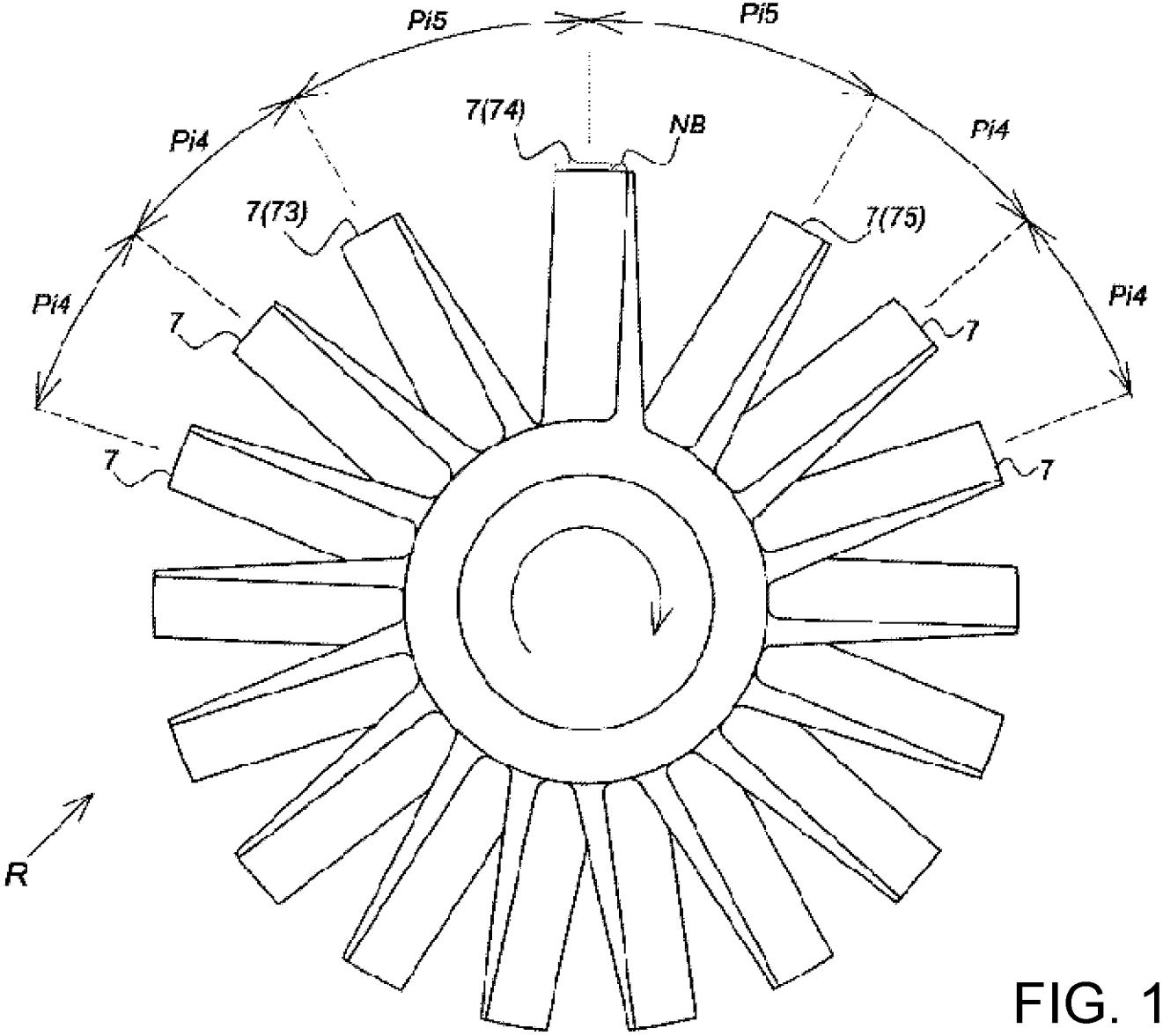
FIG. 17 is an explanatory view of the third imbalance correcting structure.

A third imbalance correcting structure corrects the imbalance described earlier by setting an arrangement interval of at least two or more rotor blades positioned on a same side as the high blade 7 (74) to be wider than an arrangement interval of other rotor blades 7 as shown in FIG. 16 or 17.

Referring to FIG. 5, in the rotating body R prior to adopting the third imbalance correcting structure, the arrangement interval of all rotor blades 7 including the high blade 7 (74) is set to Pi1.

On the other hand, in the example shown in FIG. 16, the imbalance described earlier is corrected by setting an arrangement interval Pi3 between the high blade 7 (74) and the rotor blade 7 (75) positioned on one side thereof to be wider than an arrangement interval Pi2 of other rotor blades 7.

In addition, in the example shown in FIG. 17, the imbalance described earlier is corrected by setting an arrangement interval Pi5 between the high blade 7 (74) and the rotor blades 7 (73 and 75) positioned on both sides thereof to be wider than an arrangement interval Pi4 of other rotor blades 7.

Explanation of Fourth Imbalance Correcting Structure (Counter Balance)

Figure 18:
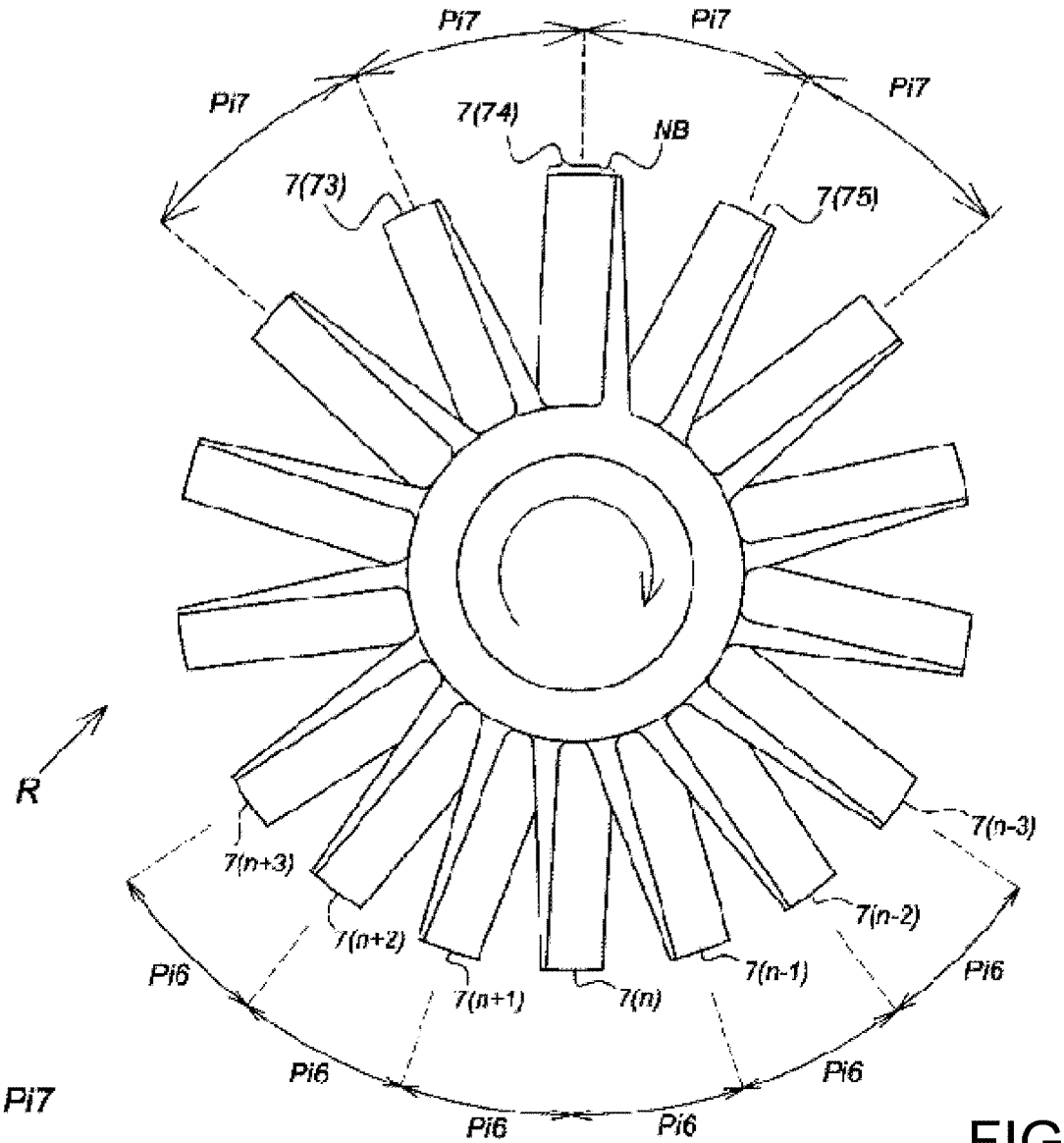
FIG. 18 is an explanatory view of a fourth imbalance correcting structure.

A fourth imbalance correcting structure corrects the imbalance described earlier by setting an arrangement interval of at least two or more rotor blades positioned on an opposite side to the high blade 7 (74) to be narrower than an arrangement interval of other rotor blades 7 as shown in FIG. 18. In other words, in the fourth imbalance correcting structure, increasing an arrangement density of the rotor blades 7 on an opposite side to the high blade 7 (74) as compared to near the high blade 7 (74) enables the rotor blades 7 on the opposite side to the high blade 7 (74) to function as a counter balance with respect to the high blade 7 (74).

While FIG. 18 shows an example in which an arrangement interval Pi6 of seven rotor blades 7 (from 7(*n*+3) to 7(*n*−3)) positioned on the opposite side to the high blade 7 (74) is set narrower than an arrangement interval Pi7 of other rotor blades 7 (for example, 7(73) and 7(76)), this example is not restrictive. The number of rotor blades at a narrow arrangement interval can be appropriately changed if necessary.

Explanation of Fifth Imbalance Correcting Structure

While the first to fourth imbalance correcting structures described above are all configured to correct the imbalance of the rotating body R as a whole in the uppermost exhaust stage PT (PT1), imbalance correcting structures are not limited thereto. A configuration in which a part of a predetermined rotor blade is removed as in the first imbalance correcting structure, a configuration in which a corresponding mass is added to a predetermined rotor blade as in the second imbalance correcting structure, and a configuration in which an arrangement interval of rotor blades is set as in the third imbalance correcting structure can be adopted in exhaust stages PT (PT1), PT (PT2), . . . PT (PTn) other than the uppermost exhaust stage PT (PT1).

Explanation of Sixth Imbalance Correcting Structure

Figure 19:
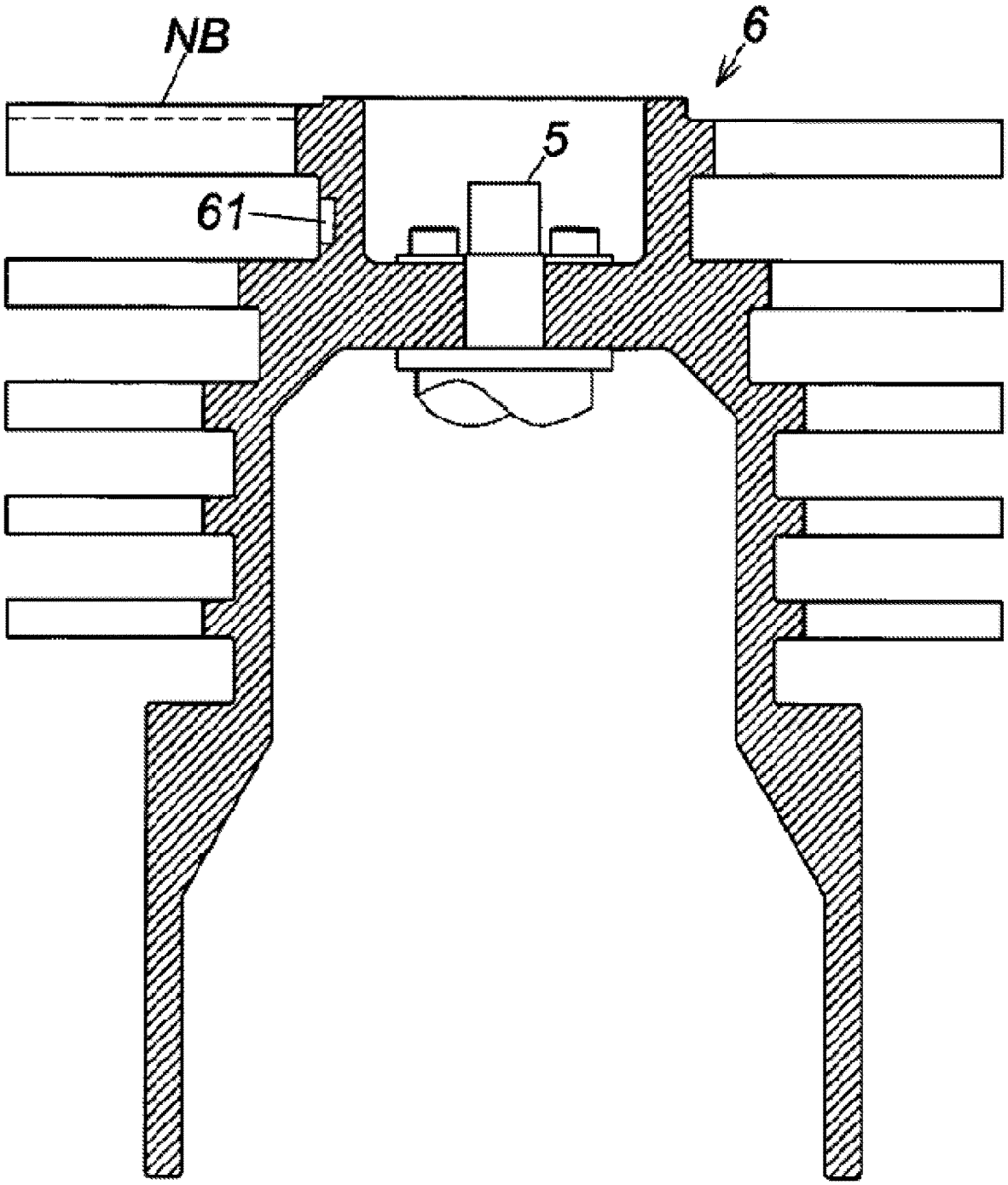
FIG. 19 is an explanatory view of a sixth imbalance correcting structure.
Figure 20:
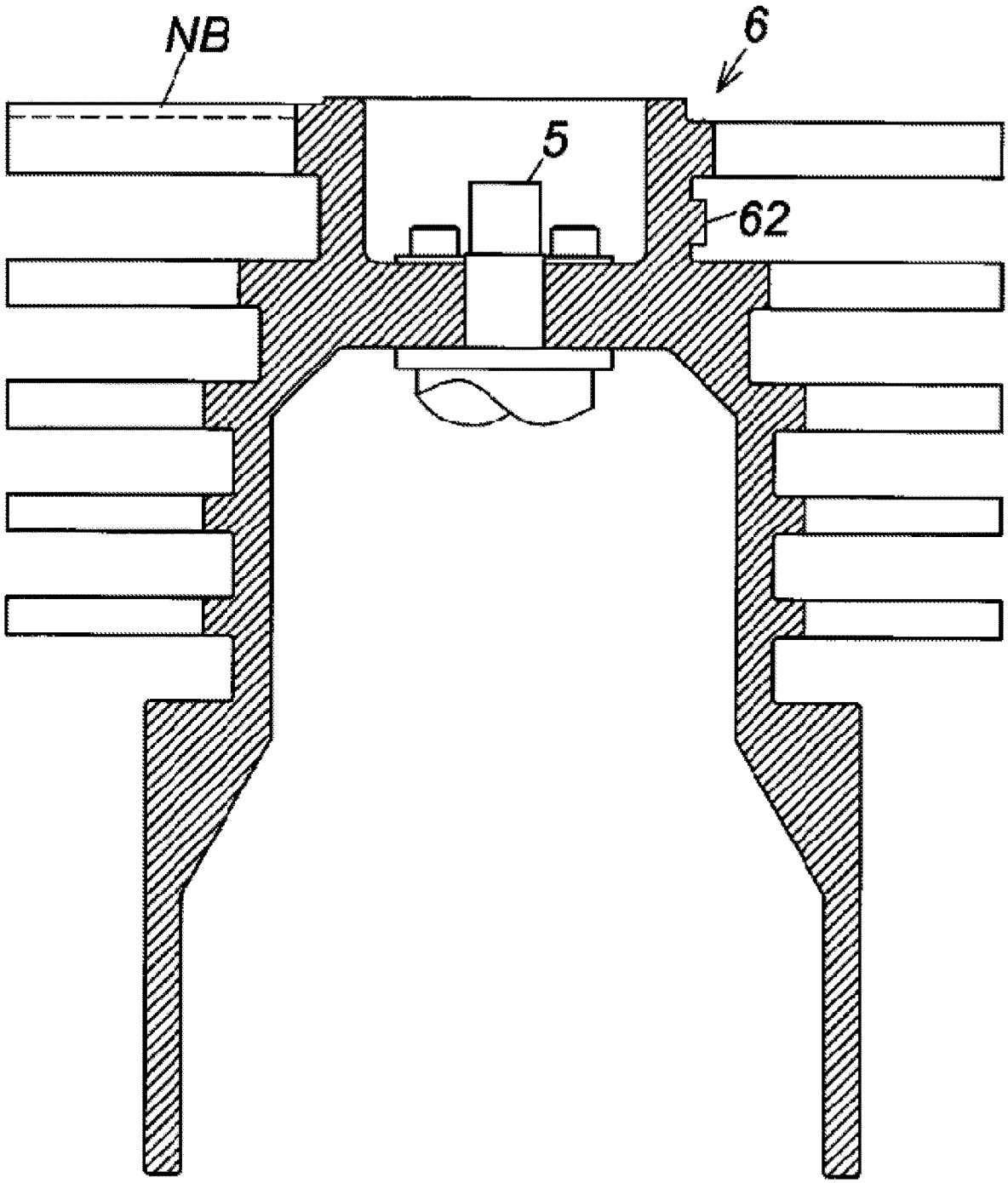
FIG. 20 is an explanatory view of the sixth imbalance correcting structure.

The sixth imbalance correcting structure corrects the imbalance described earlier by providing a depressed portion 61 or a protruding portion 62 on an outer circumferential surface (a surface without rotor blades 7) of the cylindrical portion 6 as shown in FIG. 19 or 20.

In the example shown in FIG. 19, the depressed portion 61 is provided below the uppermost exhaust stage PT (PT1) or, more specifically, directly under the high blade 7 (74) and, in the example shown in FIG. 20, the protruding portion 62 is provided below the uppermost exhaust stage PT (PT1) or, more specifically, directly under the symmetric blade 7(*n*). Alternatively, the imbalance described earlier may be corrected by concomitantly using the depressed portion 61 and the protruding portion 62.

Positions, sizes, and shapes of the depressed portion 61 and the protruding portion 62 are not limited to the examples shown in FIGS. 19 and 20 and can be appropriately changed if necessary. For example, the depressed portion 61 or the protruding portion 62 may be provided on the outer circumferential surface of the cylindrical portion 6 positioned below an exhaust stage other than the uppermost exhaust stage PT (PT1) such as below a second-from-top or third-from-top exhaust stage PT (PT2) or PT (PT3) (specifically, directly under a rotor blade 7 constituting the exhaust stages PT (PT2) and PT (PT3)).

Explanation of Seventh Imbalance Correcting Structure

Figure 21B:
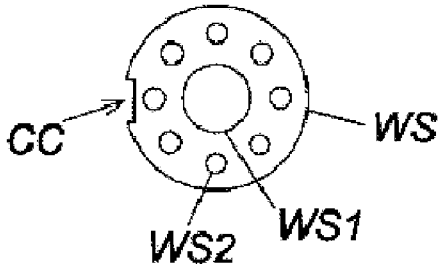
Figure 21A:
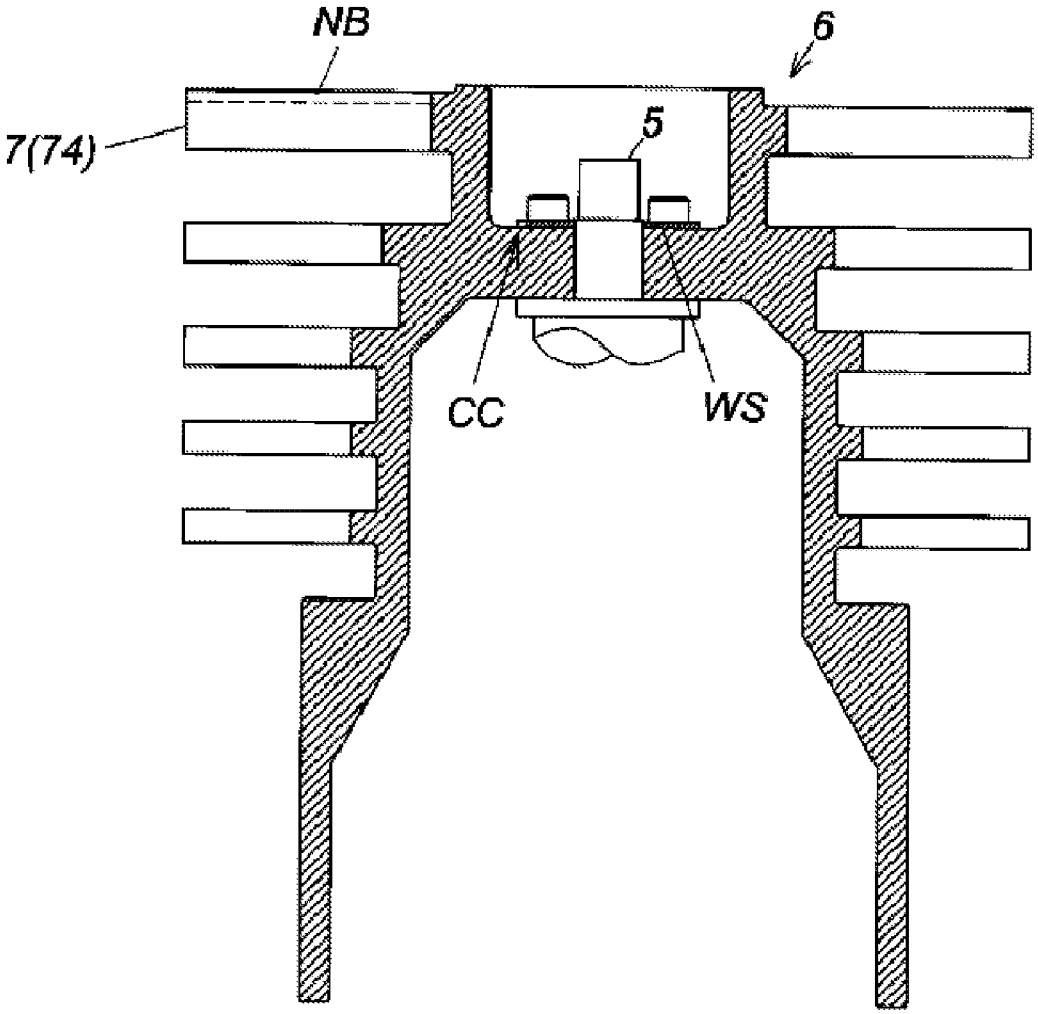

A seventh imbalance correcting structure corrects the imbalance described earlier by shaving a part of a washer WS that is used to fasten the rotating body R and the rotating shaft 5 of the rotating body R to each other as shown in FIGS. 21A and 21B.

In the example shown in FIGS. 21A and 21B, the washer WS is provided in a center portion thereof with a shaft insert hole WS1 for the rotating shaft 5, provided with a plurality of screw insert holes WS2 around the shaft insert hole WS1, and has an annular form as a whole. In addition, while the imbalance described earlier is corrected in the example shown in FIGS. 21A and 21B by shaving a portion near a base of the high blade 7 (74) among an entire outer circumference of the washer WS as indicated by a reference character CC in the drawing, this is not restrictive. A portion of the washer WS to be shaved and an amount by which the washer WS is to be shaved can be appropriately changed if necessary while determining a degree of correction of the imbalance of the rotating body R as a whole.

The first to seventh imbalance correcting structures described above may be adopted either independently or in combination.

The present invention is not limited to the embodiment described above and various modifications can be made within the technical ideas of the present invention by a person with ordinary skill in the art with respect to techniques for correcting an imbalance of a rotating body as a whole such as shaving (removing) a rotor blade, forming a hole or a groove in a rotor blade, adjusting a length of a rotor blade, adding a corresponding mass to a rotor blade, adjusting an arrangement interval of rotor blades, and selecting a member to be used in order to correct the imbalance.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump comprising:

a plurality of exhaust stages that exhaust a gas particle between an inlet port and an outlet port; and a particle transferring portion that transfers a particle in an exhaust direction of the gas particle by increasing or reducing a height of an upstream end of at least a part of rotor blades among a plurality of rotor blades that constitute an uppermost exhaust stage among the plurality of exhaust stages to realize a stepped structure in which heights of the upstream ends differ as the uppermost exhaust stage as a whole, wherein in a rotating body constituted by the plurality of rotor blades, the particle transferring portion, and a cylindrical portion that supports the plurality of rotor blades, an imbalance created with respect to the rotating body as a whole by a difference between at least one of arrangement intervals of rotor blades of which heights of the upstream end have become higher than other rotor blades due to the stepped structure and the other one of the arrangement intervals has been corrected.

2. The vacuum pump according to claim 1, wherein the imbalance is corrected by removing a part of the rotor blade of which the height of the upstream end has been made higher than the other rotor blades due to the stepped structure or removing a part of another rotor blade in proximity of the rotor blade.

3. The vacuum pump according to claim 1, wherein the imbalance is corrected by removing, among an entire blade surface of the rotor blade of which the height of the upstream end has been made higher than the other rotor blades due to the stepped structure or among an entire blade surface of another rotor blade in proximity of the rotor blade, a predetermined amount of a rear surface side in a direction of rotation that contributes less to exhaust of the gas particle.

4. The vacuum pump according to claim 1, wherein the imbalance is corrected by removing a predetermined amount of a downstream end edge of the rotor blade of which the height of the upstream end has been made higher than the other rotor blades due to the stepped structure or removing a predetermined amount of a downstream end edge of a rotor blade in proximity of the rotor blade.

5. The vacuum pump according to claim 1, wherein the imbalance is corrected by forming a hole in the rotor blade of which the height of the upstream end has been made higher than the other rotor blades due to the stepped structure or forming a hole in a rotor blade in proximity of the rotor blade.

6. The vacuum pump according to claim 1, wherein the imbalance is corrected by forming a groove in the rotor blade of which the height of the upstream end has been made higher than the other rotor blades due to the stepped structure or forming a groove in a rotor blade in proximity of the rotor blade.

7. The vacuum pump according to claim 1, wherein the imbalance is corrected by setting a length in a radial direction of the rotor blade of which the height of the upstream end has been made higher than the other rotor blades due to the stepped structure or setting a length in a radial direction of a rotor blade in proximity of the rotor blade to be shorter than a length in the radial direction of the other rotor blades.

8. The vacuum pump according to claim 1, wherein the imbalance is corrected by removing a predetermined amount of an upstream end of a rotor blade in proximity of the rotor blade of which the height of the upstream end has been made higher than the other rotor blades due to the stepped structure.

9. The vacuum pump according to claim 1, wherein the imbalance is corrected by adding a mass to a rotor blade positioned on an opposite side with respect to a center of rotation of the rotor blade of which the height of the upstream end has been made higher than the other rotor blades due to the stepped structure or with respect to a center of rotation of a rotor blade in proximity of the rotor blade.

10. The vacuum pump according to claim 1, wherein the imbalance is corrected by elongating a downstream end edge of a rotor blade positioned on an opposite side with respect to a center of rotation of the rotor blade of which the height of the upstream end has been made higher than the other rotor blades due to the stepped structure or with respect to a center of rotation of a rotor blade in proximity of the rotor blade as compared to the other rotor blades.

11. The vacuum pump according to claim 1, wherein the imbalance is corrected by setting a length in a radial direction of a rotor blade positioned on an opposite side with respect to a center of rotation of the rotor blade of which the height of the upstream end has been made higher than the other rotor blades due to the stepped structure or setting a length in a radial direction of a rotor blade in proximity of the rotor blade to be longer than a length in the radial direction of the other rotor blades.

12. The vacuum pump according to claim 1, wherein the imbalance is corrected by increasing a thickness of a rotor blade positioned on an opposite side with respect to a center of rotation of the rotor blade of which the height of the upstream end has been made higher than the other rotor blades due to the stepped structure or increasing a thickness of a rotor blade in proximity of the rotor blade as compared to the other rotor blades.

13. The vacuum pump according to claim 1, wherein the imbalance is corrected by setting an arrangement interval, as viewed from a center of rotation of the rotating body, of at least two or more rotor blades positioned on a same side as the rotor blade of which the height of the upstream end has been made higher than the other rotor blades due to the stepped structure to be wider than an arrangement interval of the other rotor blades.

14. The vacuum pump according to claim 1, wherein the imbalance is corrected by setting an arrangement interval, as viewed from a center of rotation of the rotating body, of at least two or more rotor blades positioned on an opposite side to the rotor blade of which the height of the upstream end has been made higher than the other rotor blades due to the stepped structure to be narrower than an arrangement interval of the other rotor blades.

15. The vacuum pump according to claim 1, wherein the imbalance is corrected in an exhaust stage other than the uppermost exhaust stage.

16. The vacuum pump according to claim 1, wherein the imbalance is corrected by adding a depressed portion or a protruding portion to an outer circumferential surface of the cylindrical portion.

17. The vacuum pump according to claim 1, wherein the imbalance is corrected by shaving a part of a washer that is used to fasten the rotating body and a rotating shaft of the rotating body to each other.

18. A rotating body of a vacuum pump comprising:

a plurality of exhaust stages that exhaust a gas particle between an inlet port and an outlet port; and a particle transferring portion that transfers a particle in an exhaust direction of the gas particle by increasing or reducing a height of an upstream end of at least a part of rotor blades among a plurality of rotor blades that constitute an uppermost exhaust stage among the plurality of exhaust stages to realize a stepped structure in which heights of the upstream ends differ as the uppermost exhaust stage as a whole, wherein in the rotating body constituted by the plurality of rotor blades, the particle transferring portion, and a cylindrical portion that supports the plurality of rotor blades, an imbalance created with respect to the rotating body as a whole by a difference between at least one of arrangement intervals of rotor blades of which heights of the upstream end have become higher than other rotor blades due to the stepped structure and the other one of the arrangement intervals has been corrected.

* * * * *